US010465460B2

(12) United States Patent
Barbera

(10) Patent No.: US 10,465,460 B2
(45) Date of Patent: Nov. 5, 2019

(54) CUTTING ASSEMBLY FOR A BORING DEVICE

(71) Applicant: Barbco, Inc., East Canton, OH (US)

(72) Inventor: Anthony R. Barbera, Massillon, OH (US)

(73) Assignee: Barbco, Inc., East Canton, OH (US)

( * ) Notice: Subject to any disclaimer, the term of this patent is extended or adjusted under 35 U.S.C. 154(b) by 206 days.

(21) Appl. No.: 15/634,381

(22) Filed: Jun. 27, 2017

(65) Prior Publication Data

US 2018/0371841 A1 Dec. 27, 2018

(51) Int. Cl.

| | |
|---|---|
| ***E21B 21/16*** | (2006.01) |
| ***E21B 7/20*** | (2006.01) |
| *E21B 10/18* | (2006.01) |
| *E21B 7/04* | (2006.01) |
| *E21B 10/28* | (2006.01) |
| *E21B 10/60* | (2006.01) |
| *E21B 21/00* | (2006.01) |
| *E21B 7/00* | (2006.01) |
| *E21B 7/28* | (2006.01) |
| *E21B 10/44* | (2006.01) |

(52) U.S. Cl.

CPC ..... *E21B 21/16* (2013.01); *E21B 7/20* (2013.01); *E21B 7/201* (2013.01); *E21B 7/005* (2013.01); *E21B 7/046* (2013.01); *E21B 7/28* (2013.01); *E21B 10/18* (2013.01); *E21B 10/28* (2013.01); *E21B 10/44* (2013.01); *E21B 10/60* (2013.01); *E21B 2021/005* (2013.01)

(58) Field of Classification Search

CPC . E21B 7/046; E21B 7/20; E21B 21/16; E21B 7/201

See application file for complete search history.

(56) References Cited

U.S. PATENT DOCUMENTS

| | | | |
|---|---|---|---|
| 1,932,068 | A | 10/1933 | Englebright et al. |
| 3,902,563 | A | 9/1975 | Dunn |
| 3,920,090 | A | 11/1975 | McQueen et al. |
| 4,043,136 | A | 8/1977 | Cherrington |
| 4,117,895 | A | 10/1978 | Ward et al. |
| 4,280,571 | A | 7/1981 | Fuller |
| 4,787,465 | A | 11/1988 | Dickinson, III et al. |
| 4,809,793 | A | 3/1989 | Hailey |
| 4,828,050 | A | 5/1989 | Hashimoto |

(Continued)

*Primary Examiner* — Kristyn A Hall

(74) *Attorney, Agent, or Firm* — Sand, Sebolt & Wernow Co., LPA

(57) ABSTRACT

A cutting assembly and method for drilling an underground borehole. The cutting assembly includes front and rear cutting heads of different diameters mounted on a shaft. An air passage defined through the cutting assembly may be placed in fluid communication with a pressurized remote air source and with a bore of a casing extending rearwardly from the cutting assembly. Pressurized air flows through the air passage and entrains cuttings produced by the front and rear cutting heads. A housing extends rearwardly from the larger diameter rear cutting head and an auger provided within the housing aids in directing cuttings into the casing. The auger rotates independently of the rest of the cutting assembly and may be configured to further reduce the size of the cuttings. A collar on the housing seals the borehole cut by the rear cutting assembly and aids in preventing frac-out.

17 Claims, 18 Drawing Sheets

(56) References Cited

U.S. PATENT DOCUMENTS

| | | | | |
|---|---|---|---|---|
| 5,255,750 | A | 10/1993 | Wilkes, Jr. et al. | |
| 5,314,267 | A | 5/1994 | Osadchuk | |
| 5,355,967 | A | 10/1994 | Mueller et al. | |
| 5,437,500 | A | 8/1995 | Lehmann et al. | |
| 5,711,385 | A | 1/1998 | Brotherton | |
| 6,142,246 | A | 11/2000 | Dickinson, III et al. | |
| 6,237,701 | B1 | 5/2001 | Kolle et al. | |
| 6,682,264 | B1 | 1/2004 | McGillis | |
| 6,902,014 | B1 * | 6/2005 | Estes | E21B 10/086 175/266 |
| 7,114,583 | B2 | 10/2006 | Chrisman | |
| 7,389,831 | B2 | 6/2008 | Mullins et al. | |
| 7,484,574 | B2 | 2/2009 | Burnett et al. | |
| 7,493,969 | B2 | 2/2009 | Burnett et al. | |
| 7,845,432 | B2 | 12/2010 | Salins et al. | |
| 8,113,741 | B1 | 2/2012 | Vidovic et al. | |
| 8,151,906 | B2 | 4/2012 | Salins et al. | |
| 8,210,774 | B1 | 7/2012 | Vidovic et al. | |
| 8,256,536 | B2 | 9/2012 | Harrison et al. | |
| 8,393,828 | B1 | 3/2013 | Vidovic et al. | |
| 8,439,132 | B2 | 5/2013 | Salins et al. | |
| 8,567,530 | B2 | 10/2013 | Barbera | |
| 2009/0152008 | A1 | 6/2009 | Salins et al. | |
| 2009/0152010 | A1 | 6/2009 | Salins et al. | |
| 2009/0152012 | A1 | 6/2009 | Salins et al. | |
| 2009/0288883 | A1 | 11/2009 | Barbera | |
| 2009/0301783 | A1 | 12/2009 | Salins | |
| 2011/0209921 | A1 | 9/2011 | Barbera | |
| 2012/0241221 | A1 | 9/2012 | Salins et al. | |
| 2016/0160566 | A1 * | 6/2016 | Engle | E21B 7/046 175/62 |

* cited by examiner

| | | |
|---|---|---|
| FIG.11A | FIG.11B | FIG.11B |

CUTTING ASSEMBLY FOR A BORING DEVICE

BACKGROUND OF THE INVENTION

Technical Field

The invention relates generally to an apparatus and method for drilling generally horizontal boreholes. More particularly, the invention is directed to a cutting assembly in which pressurized air is used to facilitate removal of the spoil or cuttings from the borehole. Specifically, the invention relates to a cutting assembly having a front cutting head and a larger diameter rear cutting head. A housing extends rearwardly from the rear cutting head and connects to a casing. An annular collar on the cutting assembly seals the borehole cut by the rear cutting head. Cuttings are moved through an air passage in the cutting assembly and into the casing using pressurized air and an independently rotating auger located in the housing.

Background Information

Underground boring machines have been used for many years in the drilling of generally horizontal boreholes. The machines may be used to drill boreholes that are substantially straight and those which are arcuate for the primary purpose of avoiding or bypassing an obstacle. Often such boreholes are formed by initially drilling or otherwise forming a pilot hole of a generally smaller diameter, followed by the use of an enlarged cutting head that follows the path of the pilot hole in order to enlarge the borehole.

In some cases, it may take only one pass in addition to the pilot hole to create the desired final diameter of the borehole. In other cases, the first cutting device is removed from the pilot hole and additional larger cutting devices may be used to drill the borehole in as many passes as necessary to achieve the desired diameter of borehole.

Many of the boring machines utilize an auger which is rotated in order to force the cuttings or spoil to be removed from the borehole. Such augers may be disposed in a casing and have an outer diameter which is slightly smaller than that of the inner diameter of the casing in which the auger is disposed. Drilling fluid or mud is often pumped into the borehole either within a casing or external to a casing in order to facilitate the cutting process and removal of the cuttings. Drilling fluids or lubricants may involve water, bentonite or various types of polymers, etc. The use of certain types of drilling fluids may present environmental hazards and may be prohibited by environmental laws or regulations in certain circumstances. The inadvertent return of drilling lubricant to the surface, typically referred to as "frac-out", may be of particular concern when the drilling occurs under sensitive habitats or waterways. Although bentonite is non-toxic, the use of a bentonite slurry may be harmful to aquatic plants and fish and their eggs, as these may be smothered by the fine bentonite particles if discharged into waterways.

Other issues faced in drilling applications include that the terrain itself may cause disruptions to drilling. In some instances where boring systems utilize augers to remove the cuttings from the borehole these augers are typically formed in sections that are sequentially added rearwardly as the borehole becomes longer and can accommodate additional auger sections. Given that many boreholes may be several hundred feet long, an auger of such length adds a substantial amount of weight and frictional resistance to the rotation thereof. In some instances it may be necessary to install a product with a required bend radius and the length of the drill required in these instances can be substantial in order to achieve the desired radius.

SUMMARY

There remains a need in the art for improvements with respect to boring apparatus and methods to address the above-noted problems.

An apparatus and method for drilling an underground borehole is disclosed herein. The apparatus and method addresses some of the identified problems of previously known devices and methods.

In the presently disclosed apparatus and method pressurized air may be used to discharge cuttings produced by the disclosed cutting assembly. The cutting assembly may include a front cutting head and a larger diameter rear cutting head mounted on a shaft. An air passage defined through the cutting assembly may be placed in fluid communication with a pressurized remote air source and with a bore of a casing extending rearwardly from the cutting assembly. Pressurized air flows through the air passage and entrains cuttings produced by the front and rear cutting heads. A housing extends rearwardly from the larger diameter rear cutting head and an auger provided within the housing aids in directing cuttings into the casing. The auger rotates independently of the rest of the cutting assembly and may be configured to further reduce the size of the cuttings being moved thereby. A collar on the housing seals the borehole cut by the rear cutting assembly and aids in preventing frac-out.

In one aspect, the invention may provide a cutting assembly for drilling a borehole, said cutting assembly comprising a front cutting head of a first diameter; a rear cutting head of a second diameter, wherein the second diameter is greater than the first diameter; a shaft operatively engaging the front cutting head and the rear cutting head; wherein said rear cutting head is located rearwardly of the front cutting head along the shaft; and wherein the front cutting head, the rear cutting head and the shaft are rotatable in unison about a longitudinal axis of the shaft in a first direction; and an air passage defined in the cutting assembly; said air passage adapted to be operatively engaged with a remote air source located forwardly of the cutting assembly and with a bore of a casing located rearwardly of the cutting assembly; wherein pressurized air from the remote air source flows through the air passage and entrains cuttings produced by the front cutting head and the rear cutting head and directs the cuttings into the bore of the casing.

In another aspect, the invention may provide an apparatus for drilling boreholes comprising a cutter assembly; a swivel; and a casing; wherein the cutter assembly connectable between the swivel and the casing; said cutter assembly comprising a front cutting head of a first diameter; a rear cutting head of a second diameter, wherein the second diameter is greater than the first diameter; and wherein said rear cutting head is located rearwardly of the front cutting head; a shaft engaging the front cutting head to the rear cutting head; wherein the front cutting head, the rear cutting head and shaft are rotatable in unison in a first direction about a longitudinal axis of the shaft; and an air passage defined in the cutting assembly; wherein the air passage is in fluid communication with a bore defined by the swivel and with a bore defined by the casing; wherein the apparatus is adapted to be operatively engaged with a remote air source; and wherein pressurized air flowing from the air source through the bore of the swivel and through the air passage entrains cuttings produced by the front cutting head and the rear cutting head and directs the cuttings towards the bore of the casing.

In another aspect, the invention may provide a method of drilling an underground borehole comprising steps of rotating and moving forward a cutting assembly and a casing extending rearwardly from the cutting assembly; cutting a first diameter borehole with a first diameter front cutting head provided on the cutting assembly; cutting a second diameter borehole with a second diameter rear cutting head provided on the cutting assembly, wherein the rear cutting head is located rearwardly of the front cutting head on a shaft of the cutting assembly; moving pressurized air rearwardly through a first air passage formed in the front cutting head and through a second air passage formed in the rear cutting head; entraining cuttings produced by the front cutting head and the rear cutting head in the moving pressurized air; and directing the pressurized air with entrained cuttings into a bore of the casing extending rearwardly from the cutting assembly.

The method may further comprise sealing the second diameter borehole with a collar provided on the cutting assembly. The method may further comprise rotating the front cutting head, the rear cutting head and the shaft in a first direction about a longitudinal axis of the shaft; selectively rotating an auger provided on the cutting assembly in either of the first direction or the second direction; and directing the pressurized air with entrained cuttings towards the auger and subsequently into the bore of the casing. The method may further comprise rotating the front cutting head, the rear cutting head and the shaft at a first speed; and selectively rotating the auger at the first speed or at a second speed that is greater than the first speed or is less than the first speed.

The method may further comprise contacting the entrained cuttings with teeth provided on the auger; and reducing a size of the entrained cuttings with the teeth. The method may further comprise a step of adjusting back pressure in the first air passage and the second air passage by changing a pattern of holes in an end plate provided on the auger.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1A:
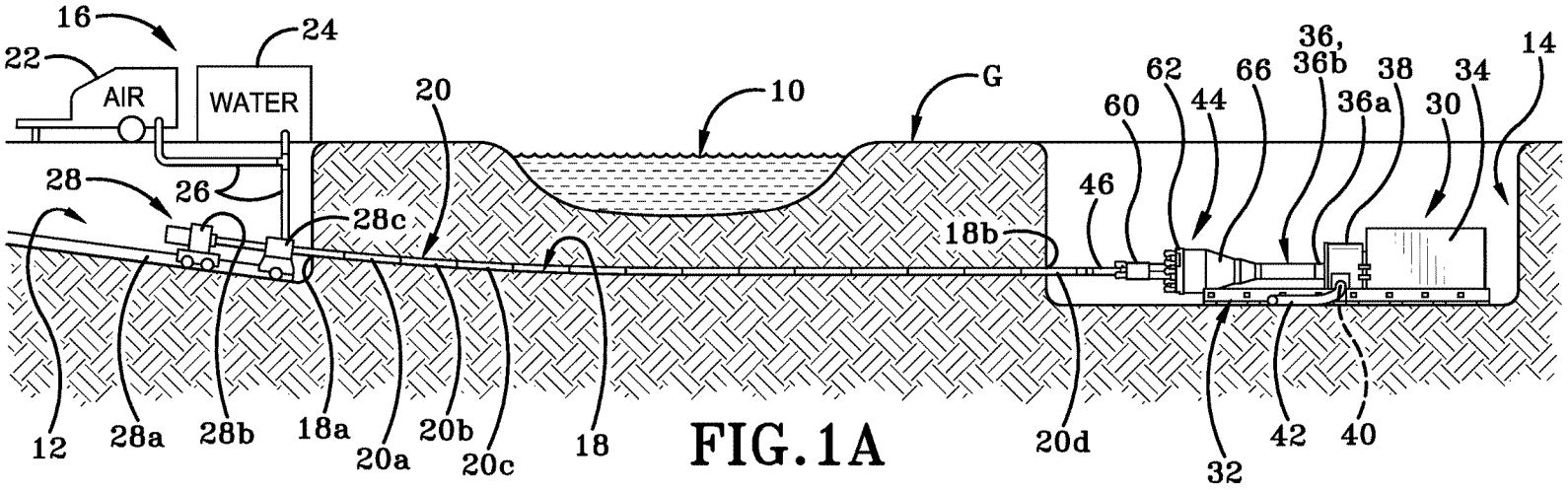
FIG. 1A is a diagrammatic side elevation view of a horizontal directional drilling system with the ground shown in section to illustrate a pilot hole formed in the ground with the pilot tube remaining within the pilot hole.

FIG. 1 shows an area of terrain or ground "G" that includes an environmental obstacle 10 under which it is necessary to drill a borehole in order to lay a length of pipe. The obstacle 10 in this particular instance is illustrated as a body of water such as a stream, a river, a pond or a lake. It will be understood, however, that obstacle 10 may represent any other type of obstacle such as roads, buildings, walls, and trees and so forth such that trenchless or horizontal directional drilling (HDD drilling) is desirable or required.

In order to conduct a drilling operation in ground "G", a first pit 12 is dug in the ground "G" on one side of obstacle 10 and a second pit 14 is dug in ground "G" on the opposite side of obstacle 10. First pit 12 may be used to set up a control assembly 16 that may include a variety of different pieces of equipment at various times. Some of the equipment may be utilized to drill a pilot hole 18 from first pit 12 to second pit 14 and for inserting a pilot tube 20 therein. Pilot hole 18 (and a larger diameter borehole cut by a cutting assembly in accordance with an aspect of the present invention—to be discussed later herein) may be of a substantial length such as 50, 76, 150, 200, 250 or 300 feet or more. Thus, first and second pits 12, 14 may be located a distance remote from each other. The method of drilling of pilot tube 18 and the insertion of a pilot tube 20 in pilot hole 18 are known in the art and are therefore not discussed in greater detail herein. Pilot tube 20 may be made up of a plurality of pilot tube segments 20*a*, 20*b*, 20*c*, 20*d* and so on, that are connected to one another in an end-to-end fashion and are selectively engageable with and detachable from one another. For instance, each adjacent pair of segments, such as segments 20*a* and 20*b*; and 20*b* and 20*c*, may be joined to one another by a threaded engagement or by any other suitable type of connection known in the art. Each of segments 20*a*, 20*b*, 20*c*, 20*d* etc. defines a bore therein that extends from one end of the segment to the other end thereof. When the various segments are connected together, the pilot tube segment bores are put in fluid communication with one another. Pilot tube 20 thereby defines a bore therethrough that extends from the front end of the pilot tube 20 to the rear end thereof. For the purpose of the present description the front end of pilot tube 20 may be considered to be that part of the pilot tube 20 that is closest to first pit 12 and the rear end of pilot tube 20 is that part of the pilot tube that is initially adjacent second pit 14.

In accordance with an aspect of the present invention, control assembly 16 may include an air supply, such as air compressor 22, and a water supply 24 positioned in or adjacent first pit 12. Air compressor 22 and water supply 24 are operatively engaged via hoses or conduits 26 to pilot tube 20. The hoses or conduits 26 put air compressor 22 and water supply 24 into fluid communication with the bore defined in pilot tube 20. Air compressor 22 and water supply 24 may selectively provide pressurized air or water or another fluid, respectively, to pilot tube 20 and thereby to a cutting assembly that is connected to pilot tube 20, as will be described later herein.

A cutting assembly 44 in accordance with an aspect of the invention is operatively engaged with pilot tube 20 and is thereby put into fluid communication with air compressor 22 and water supply 24. Preferably in accordance with an aspect of the present invention, only pressurized air is caused to flow through the pilot tube 20 from air compressor 22 through an air passage defined in cutting assembly 44. The pressurized air flows through the air passage in cutting assembly 44 in order to discharge cuttings produced by cutting assembly 44 into a casing 36 attached to cutting assembly 44 and to move the cuttings through and out of the casing 36. Not using water or other liquids to discharge the cuttings produced by cutting assembly 44 aids in protecting the environment and aids in preventing frac-out during cutting operations.

Figure 1B:
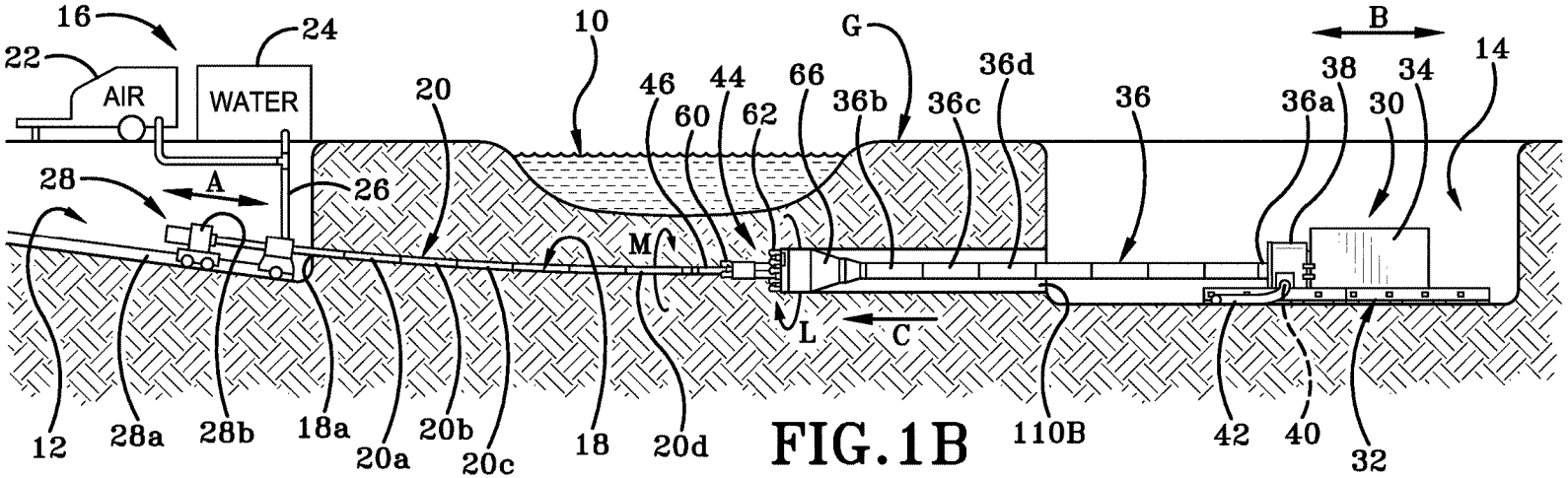
FIG. 1B is a diagrammatic side elevation view of the horizontal directional drilling system with the ground shown in section showing the pilot tube remaining in the pilot hole and showing a cutting assembly in accordance with an aspect of the present invention engaged with the pilot tube.

Control assembly 16 may also comprise a drilling rig assembly 28 that includes tracks 28*a* anchored in first pit 12 and a motor 28*b* that is able to move back and forth in the manner indicated by arrows "A" (FIG. 1B). Motor 28*b* may be selectively engaged via a swivel assembly 28*c* to sections 20*a*, 20*b*, 20*c*, and 20*d* of pilot tube 20 during installation of pilot tube 20 and during subsequent removal thereof as drilling operations progress. Motor 28*b* is actuated to rotate pilot tube 20 about a longitudinal axis of tube 20.

A horizontal directional drilling (HDD) rig 30 may be placed in second pit 14. HDD rig 30 may include tracks 32 (FIG. 1A) that are anchored to ground "G" in the second pit 14. HDD rig 30 is able to move forward and rearward on tracks 32 during a drilling or boring operation in the direction indicated by arrows "B" (FIG. 1B). While tracks 32 are shown in FIGS. 1A and 1B as being horizontally oriented it will be understood that they may, instead, be angled relative to the horizontal. If this latter situation is the case then the pilot hole 18 at its rear end 18*b* adjacent second pit 14 may be oriented at an angle relative to the horizontal.

Rig 30 may include an engine 34 that rotates a drive shaft that is coupled to a rearmost segment 36*a* of a casing 36. Rig 30 may further include a front discharge box 38. Casing segment 36*a* may originate within discharge box 38 and extend forwardly out of discharge box 38. Discharge box 38 may also have an outlet or exit port 40 that may have connected to it a discharge conduit or hose 42. During forward and rearward movement of rig 30 as indicated by arrow "B" in FIG. 1B, the engine 34, front discharge box 38, rearward casing segment 36*a* and hose 42 move relative to tracks 32 and ground "G".

As indicated previously herein, an earth-boring or cutting assembly 44 in accordance with an aspect of the present invention may be secured between pilot tube 20 and casing 36. Engine 38 is provided to drive cutting assembly 44 in a forward direction (i.e., from second pit 14 towards first pit 12) and to rotate cutting assembly 44 in order to cut through the ground "G".

Figures 2, 2A, 2B:
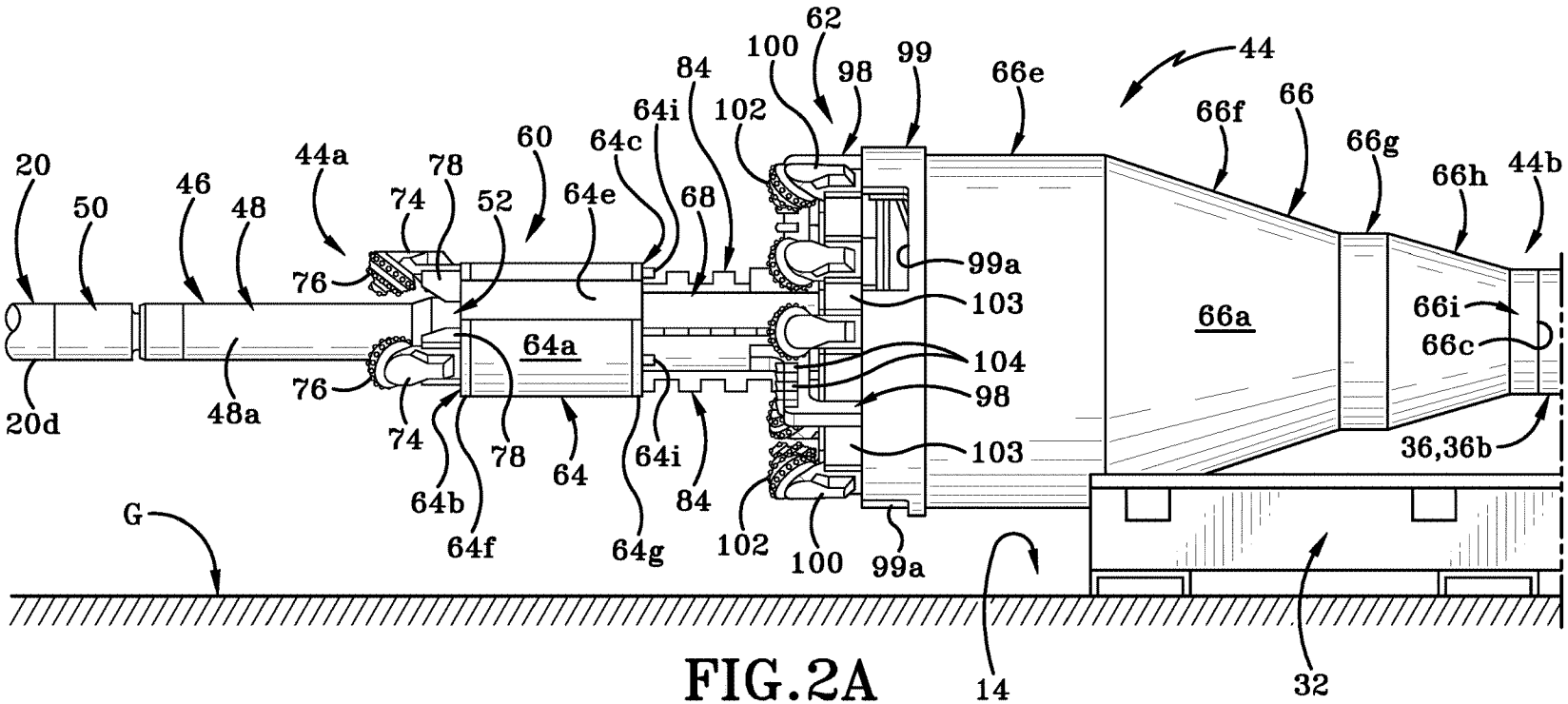
FIG. 2 is a block diagram showing that the components illustrated in FIG. 2A and FIG. 2B are oriented in a particular manner.
FIG. 2A is a side elevational view showing a front end of the cutting assembly in accordance with the an aspect of the present invention engaged with the pilot tube via a swivel.
FIG. 2B is a side elevation view showing a portion of a casing extending from a rear end of the cutting assembly of FIG. 2A where the casing is engaged with and extends forwardly from a power drive of a horizontal directional drilling rig.
Figure 2B:
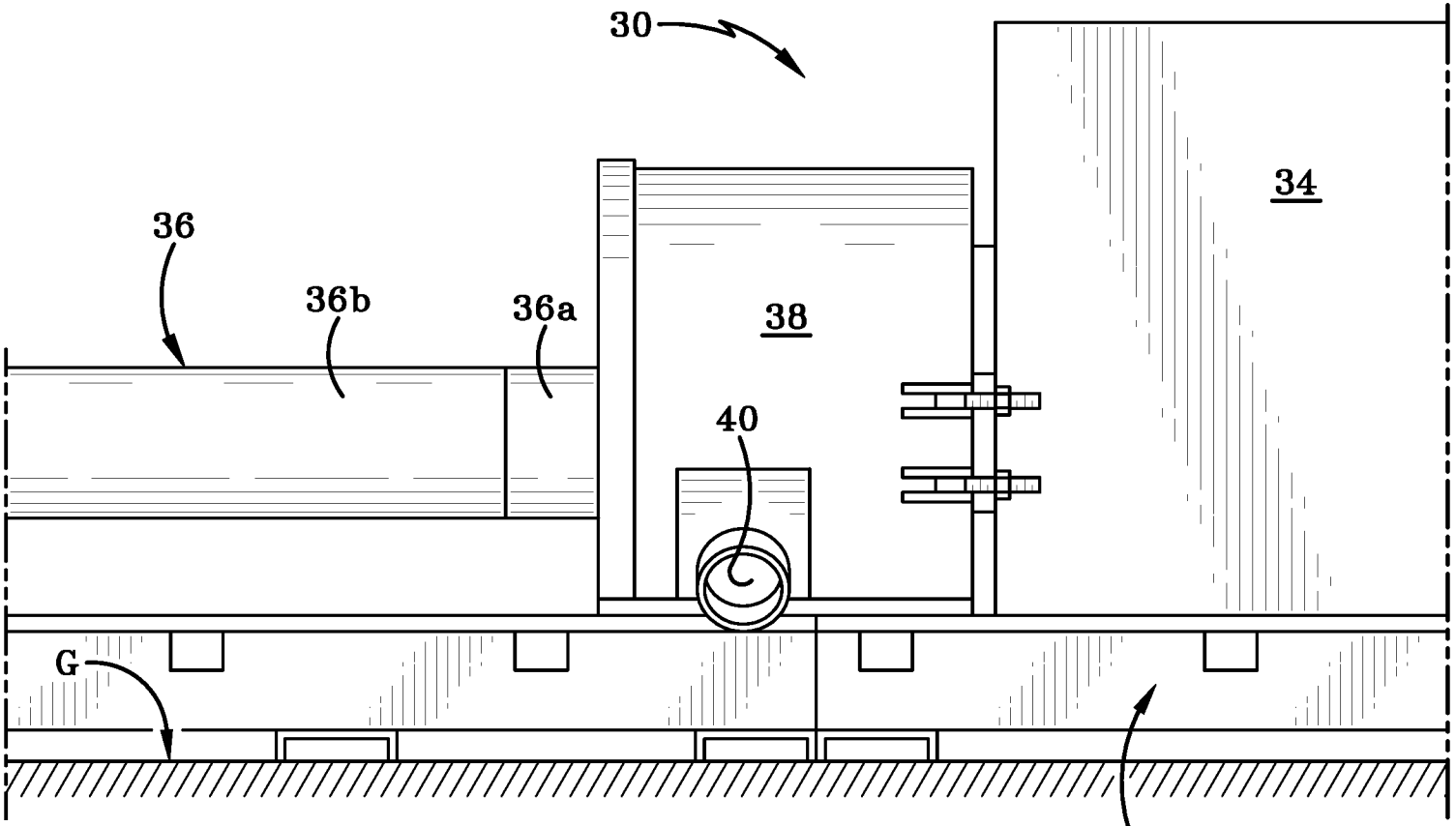

FIG. 2A shows that cutting assembly 44 has a front end 44*a* and a rear end 44*b*. While engaged with pilot tube 20, cutting assembly 44 will advance and cut through the earth in the direction indicated by arrow "C" in FIG. 1B, i.e., in a direction from second pit 14 towards first pit 12. As the cutting operation progresses and cutting assembly 44 moves towards first pit 12, segments of pilot tube 20 are successively removed. At the same time, additional casing segments, such as segments 36*b*, 36*c*, and 36*d* will be successively added between cutting assembly 44 and the rearmost casing segment 36*a*. In other words, as cutting advances in the direction of arrow "C", the pilot tube 20 progressively gets shorter and the casing 36 (made up of casing segments 36*a*, 36*b*, 36*c*, 36*d* etc.) will progressively get longer. The casing segment 36*b* will be referred to in this description as forwardmost casing segment 36*b*.

Figures 11, 11A:
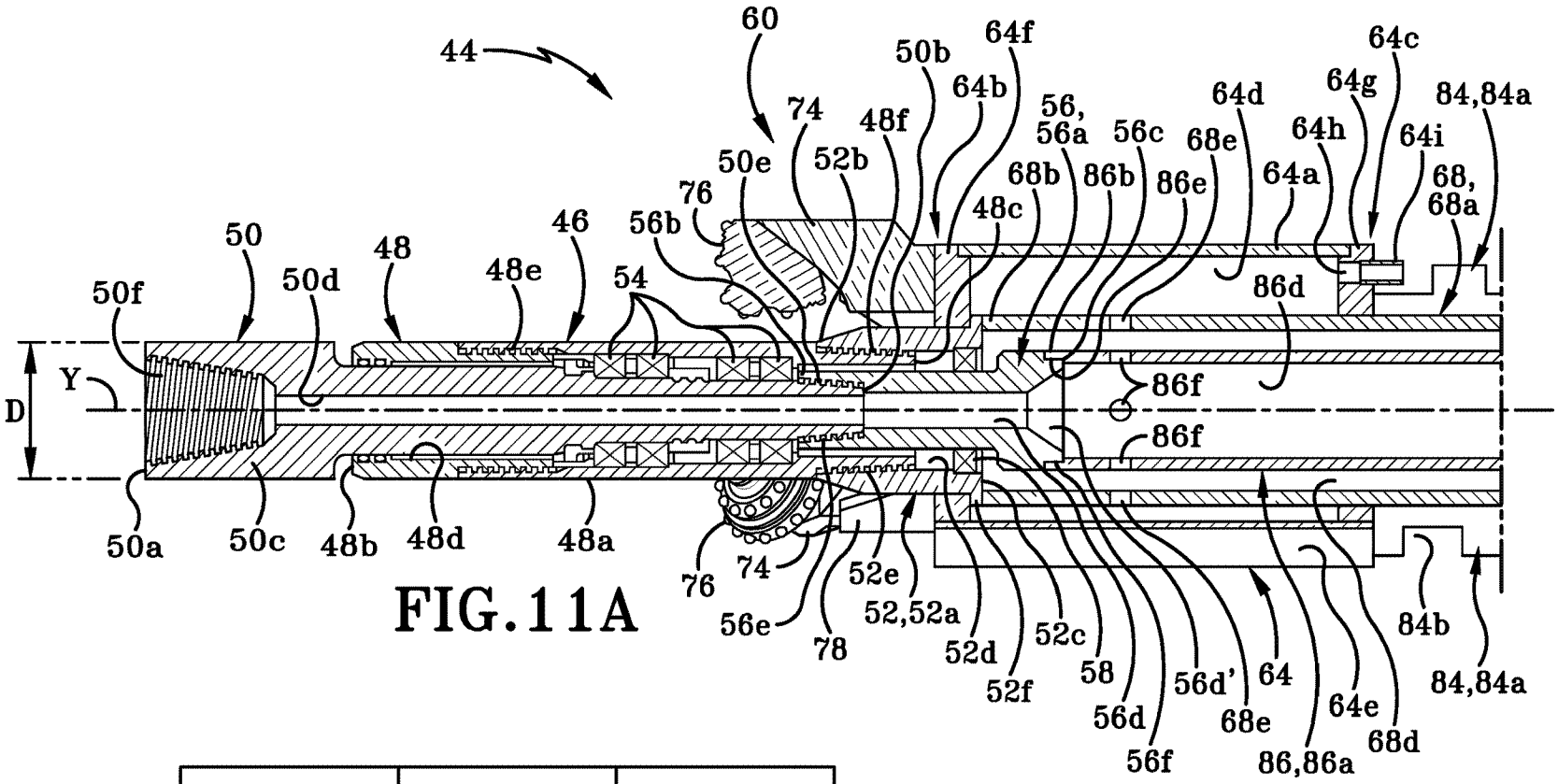
FIG. 11 is a block diagram showing that the components illustrated in FIG. 11A, FIG. 11B and FIG. 11C are oriented in a particular manner, and wherein FIGS. 11A, 11B and 11C together are a longitudinal cross-section taken along line 11-11 of FIG. 10.
FIG. 11A is a longitudinal cross-section of the front cutting head and central shaft of the cutting assembly.

Front end 44*a* of cutting assembly 44 is secured to a rearmost segment 20*d* of pilot tube 20 via a swivel 46. Swivel 46 ensures that cutting assembly 44 is able to rotate without rotating pilot tube 20. FIG. 11A shows that swivel 46 may include an outer portion 48 and an inner portion 50 which are rotatable relative to one another about a longitudinal axis "Y". Outer portion 48 may include a generally cylindrical sidewall 48*a* that has a front end 48*b* and a rear end 48*c*. Rear end 48*c* may serve as the rear end of swivel 46. Sidewall 48*a* of outer portion 48 may comprise, for example, two segments which are threadedly secured to one another at a threaded connection 48*e*. Outer portion 48 may include an externally threaded portion 48*f* proximate rear end 48*c* that may threadedly engage a front end of a swivel mount 52.

Swivel mount 52 may have a generally circular peripheral wall 52*a* having a front end 52*b* and a rear end 52*c*. Peripheral wall 52*a* may taper towards front end 52*b*.

Peripheral wall 52*a* may have an inner surface that bounds and defines an interior bore 52*d*. An internally threaded portion 52*e* of the inner surface of wall 52*a* may extend rearwardly from front end 52*b*. A threaded connection may be made between threads 48*e* on outer portion 48 and threads 52*e* on swivel mount 52. This threaded engagement may secure outer portion 48 rigidly on swivel mount 52. Outer portion 48 may extend outwardly and forwardly from front end 52*b* of swivel mount 52.

Sidewall 48*a* may have a cylindrical outer surface which may be concentric about longitudinal axis "Y" and define an outer diameter "D" (FIG. 11A). Outer portion 48 may further include an inner surface that extends from front end 48*b* to rear end 48*c* and bounds and defines a bore 48*d* that likewise extends from front end 48*b* to rear end 48*c* of swivel 46. Swivel mount 52 also has an annular shoulder 52*f* that is of a greater diameter than the rest of the peripheral wall 52*a* of the swivel mount 52. Annular shoulder 52*f* is located proximate rear end 52*c* of swivel mount 52.

Inner portion 50 of swivel 46 has a front end 50*a* and a rear end 50*b*. Front end 50*a* may serve as the front end of swivel 46. Inner portion 50 includes a sidewall 50*c* which defines an air passage 50*d* that extends from front end 50*a* to rear end 50*b*. Sidewall 50*c* may be concentric about longitudinal axis "Y" and an inner surface that bounds and defines swivel air passage 50*d* extends from front end 50*a* to rear end 50*b* of inner portion 50. A front region of sidewall 50*c* proximate front end 50*a* may be of a greater diameter than a rear region proximate rear end 50*b*. The rear region may be tapered and be externally threaded with threads 50*e* (FIG. 11A). Sidewall 50*c* may also include a middle region that is located between the greater diameter front region proximate front end 40*a* and the tapered region proximate rear end 50. The middle region of inner portion 50 may be received in bore 48*d* and the outer surface of the middle region of side wall 50*c* may be spaced from the inner surface of the outer portion 48. A plurality of bearings 54 may be provided within bore 48*d* and extend from the inner surface of the outer region 48 to the outer surface of the inner region 50. The greater diameter section of sidewall 50*c* may have an internally threaded and tapered portion 50*f* adjacent and extending rearwardly from front end 50*a*. Threaded portion 50*f* is configured to threadedly engage a rear end or trailing end of pilot tube 20 to secure pilot tube 20 to portion 50 of swivel 46.

A connector sleeve 56 engages rear end 50*b* of inner portion 50 of swivel 46. Connector sleeve 56 has a peripheral wall 56*a* with a front end 56*b* and a rear end 56*c* and defines a bore 56*d* therein that extends from front end 56*b* to rear end 56*c*. Connector sleeve 56 includes a narrower diameter region that includes front end 56*b* and a wider diameter region that includes rear end 56*c*. The narrower diameter of connector sleeve 56 may have a tapered and internally threaded region 56*e* that extends rearwardly from front end 56*b*. The narrower diameter region may be received through bore 52*d* of swivel mount 52 and into passage 48. Threaded region 56*e* of connector sleeve 56 may be threadedly engaged with threaded end 50*g* of inner portion 50 of swivel 46. Bearings 58 may be provided between an exterior surface of the narrower diameter region of connector sleeve 56 and an interior surface of swivel mount 52 so that there may be independent rotation of connector sleeve 56 relative to swivel mount 52. When connector sleeve 56 is engaged with inner portion 50 of swivel 46 there is fluid communication between passage 50*d* of inner portion 50 and bore 56*d* of connector sleeve 56. Connector sleeve 56 is thereby put into fluid communication with the bore of pilot tube 20. As may be seen from FIG. 11A, a terminal region of the bore 56*d* flares outwardly, progressively becoming greater in diameter towards rear end 56*c*. This flared diameter region is identified in FIG. 11A by the reference number 56*d*'. Rear end 56*c* also defines an exterior annular groove 56*f*. Inner portion 50 of swivel 46 is connected to pilot tube 20.

Cutting assembly 44 is shown in greater detail in FIGS. 2-12B. Cutting assembly 44 may comprise a front cutting head 60, a rear cutting head 62, a first housing 64, a second housing 66, a shaft 68 and an auger 70. Pilot tube 20 is operatively engaged with auger 70 and drives the rotation of auger 70 in either of the opposite direction "M" to cutting assembly 44 or in the same direction as cutting assembly 44 (i.e., in the opposite direction of arrow "M"). Additionally, cutting assembly 44 may be rotated at a first speed and pilot tube 20 and auger 70 may selectively be rotated and the first speed (i.e., the same speed as cutting assembly 44) or at a second speed that is greater than the first speed or is less than the first speed. In other words, auger 70 may be rotated at a same speed or at different speed relative to the speed of rotation of cutting assembly 44. The various rotational directions and speeds of rotation of cutting assembly 44 and auger 70 may be selected based on the type of terrain, the soils, rocks etc. that have to be cut through or any other factors that may affect the cutting ability of cutting assembly 44 and removal of material cut during operation of cutting assembly 44.

Referring to FIGS. 3, 11A, 11B and 12A, shaft 68 extends between front cutting head 60 and rear cutting head 62 and is engaged with front cutting head 60 and rear cutting head 62 in such a way that front cutting head 60, rear cutting head 62 and shaft 68 will rotate in unison about a longitudinal axis "Y" (FIG. 11A) of shaft 68.

Shaft 68 may be a cylindrical member having annular wall 68*a*, a front end 68*b* (FIG. 11A) and a rear end 68*c* (FIG. 11B) located a distance from front end 68*b*. Shaft 68 may be concentric about longitudinal axis "Y" of shaft 68 and thereby of cutter assembly 44. Inner surface of wall 68*a* of shaft 68 defines a longitudinal bore 68*d* that extends from front end 68*b* to rear end 68*c*. Front end 68*b* is engaged with swivel mount 52, specifically annular shoulder 52*f* thereof, in any suitable manner such as by welding, and in such a way that swivel mount 52 and shaft 68 will rotate in unison with each other about longitudinal axis "Y".

Figure 11B:
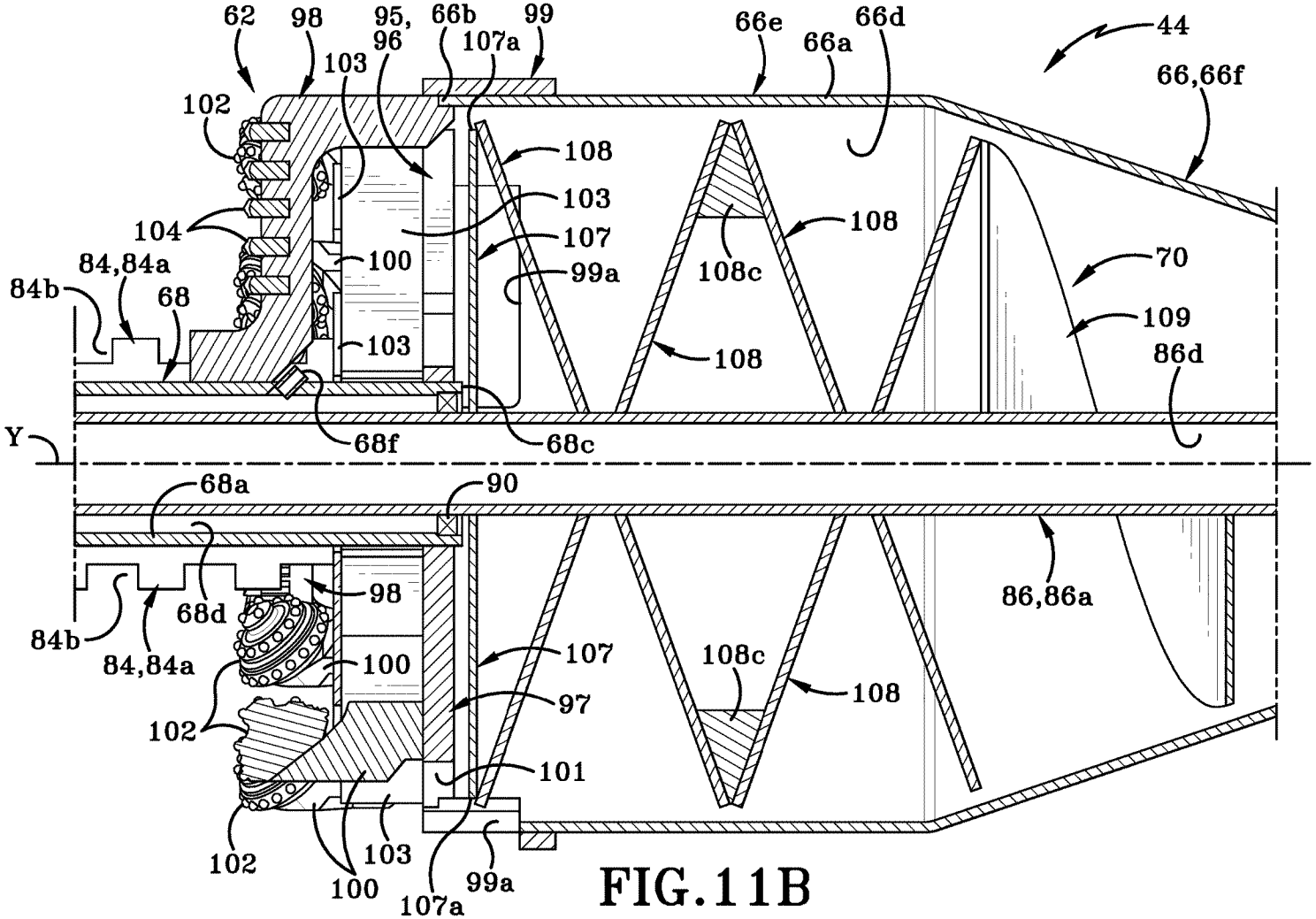
FIG. 11B is a longitudinal cross-section through a middle portion of the rear cutting head and housing and showing the auger located in the interior of the housing.

Peripheral wall 68*a* of shaft 68 may define a plurality of first holes 68*e* and second holes 68*f* therein that extend between an exterior surface of wall 68*a* and an interior surface thereof. First holes 68*e* may be located a short distance rearwardly of front end 68*b* of shaft 68 and second holes 68*f* may be located a short distance forwardly of rear end 68*c* of shaft 68. First holes 68*e* may be oriented generally perpendicular to longitudinal axis "Y" while second holes 68*f* may each include a nozzle that extends outwardly from peripheral wall 68*a* and is oriented at an acute angle relative to wall 68*a* and to longitudinal axis "Y" (FIG. 11B). It will be understood that shaft 68 may be fabricated to include fewer or more first holes 68*e* and second holes 68*f* and may even be provided with additional holes along the length of shaft 68.

Front cutting head 60 may include a first housing 64 having a peripheral wall 64*a* with a front end 64*b* and a rear end 64*c*. A front plate 64*f* is provided at front end 64*b* of peripheral wall 64*a* and closes off access to a front end of the first housing 64. Front plate 64*f* engages an exterior surface of swivel mount 52 and interlocks with annular shoulder 52*f* on swivel mount 52. A rear plate 64*g* is provided at rear end

64*c* of peripheral wall 64*a* and closes off access to a rear end of first housing 64. The peripheral wall 64*a*, front plate 64*f* and rear plate 64*g* bound and define an interior chamber 64*d*. Peripheral wall 64*a*, front plate 64*f* and rear plate 64*g* each define one or more fluted regions 64*e* that can best be seen in FIGS. 5A, 6, and 7. Fluted regions 64*e* allow materials cut as cutting assembly 44 rotates to be moved rearwardly away from front cutting head 60 as cutting assembly 44 moves forwardly.

Interior chamber 64*d* (FIG. 12A) extends from front plate 64*f* to rear plate 64*g* and from inner surface of peripheral wall 64*a* of first housing 64 to exterior surface of peripheral wall 68*a* of shaft 68. A plurality of holes 64*h* are defined in rear plate 64*g* and nozzles 64*i* are positioned within the holes 64*h*. Each nozzle 64*i* may be directed rearwardly away from rear plate 64*g* and may be oriented generally parallel to longitudinal axis "Y".

Front cutting head 60 further includes a plurality of arms 74 with roller cones 76 mounted thereon. Each arm 74 extends outwardly and forwardly from a front surface of front plate 64*f* on first housing 64. Each of the plurality of arms 74, is are mounted on front plate 64*f* in such a way that they extend outwardly away from the front surface of front plate 64*f* in a direction that may be generally parallel to the longitudinal axis "Y" of shaft 68. A roller cone 76 is mounted proximate a free end of each arm 74 and in such a way that roller cone 76 may rotate about an axis that passes through a central region of the roller cone 76 and into the free end of the associated arm 74, Roller cone 76 may be of a configuration such as is illustrated in the attached figures but it will be understood that other types of cutters may be utilized in the place of roller cones 76 depending on what is required by any particular terrain, ground or rock that needs to be bored into by cutting assembly 44.

Figure 6:
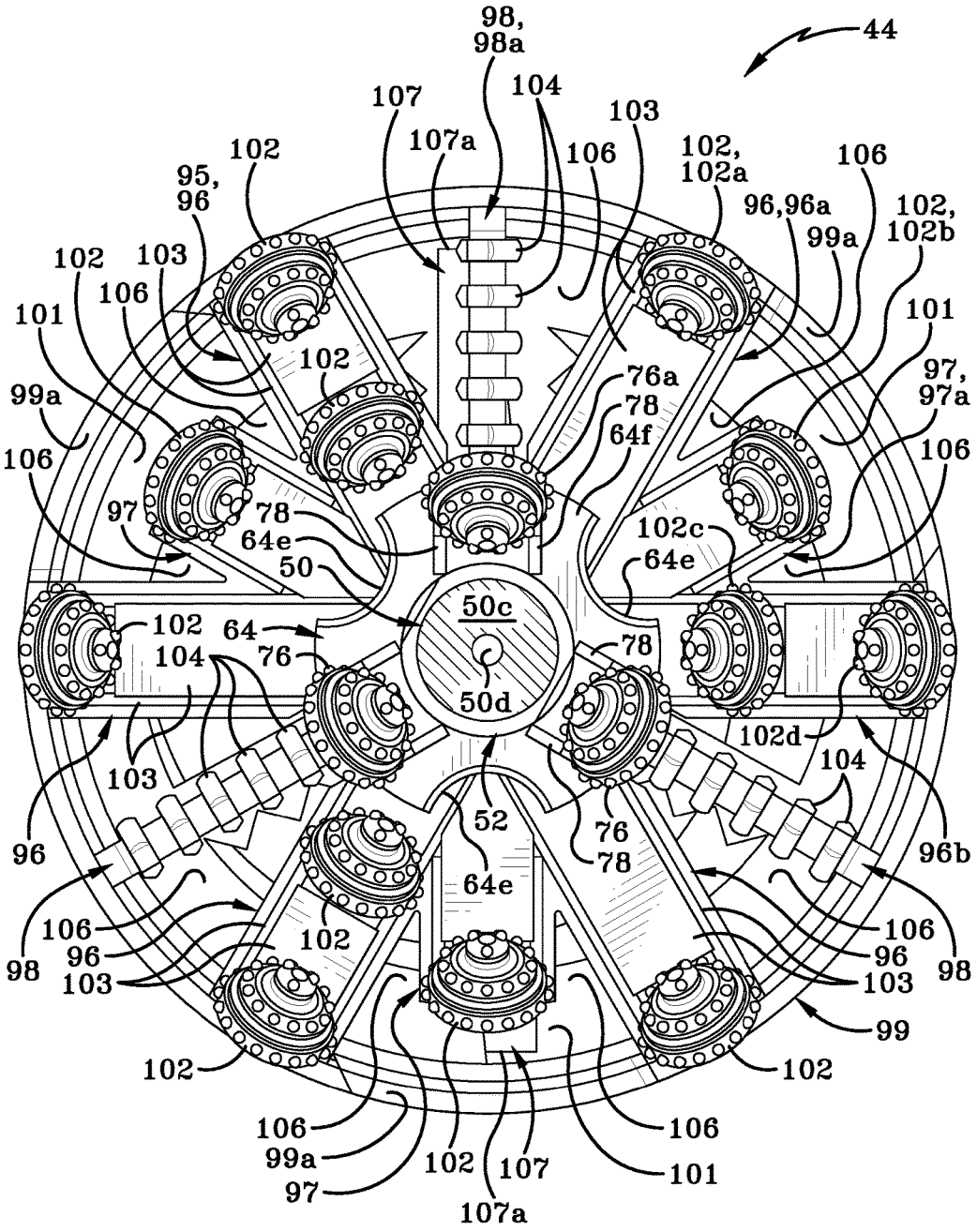
FIG. 6 is a front end view of the cutting assembly taken along line 6-6 of FIG. 5A.

A pair of plates 78 may flank each arm 74 and extend outwardly and forwardly from the front surface of front plate 64*f* of first housing 64. Plates 78 may be oriented generally at right angles to the front surface of front plate 64*f*. FIG. 6 shows that the two plates 78 in each pair of plates 78 may be oriented generally parallel to each other. The plates 78 are located on either side of an associated arm 74 and roller cones 76 and so cut and ground material passes into spaces between the arms and is guided by plates 78 downwardly toward rear cutting head 62. As will be described later herein this rearward movement of cut and ground material is aided in moving rearwardly by air that exits first housing 64 through nozzles 64*i* and is swept rearwardly by the air towards rear cutting head 62. Roller cones 76 and plates 78 are components that are used to cut and grind through rock and soil as cutting assembly 44 advances in the direction of arrow "C" (FIG. 1B).

As is evident from FIG. 2A, front cutting head 60 is of a smaller exterior diameter than rear cutting head 62. Front plate 64*f*, arms 74, plates 78, swivel mount 52 and shaft 68 may be welded together and because of this all of these components will move in unison with each other as cutting assembly 44 rotates about longitudinal axis "Y". Swivel mount 52 is threadedly engaged with outer member 48 of swivel 46. Consequently, outer member 48 of swivel 46 will rotate in unison with shaft 68 and independently of the inner member 50 of swivel 46.

Figure 3:
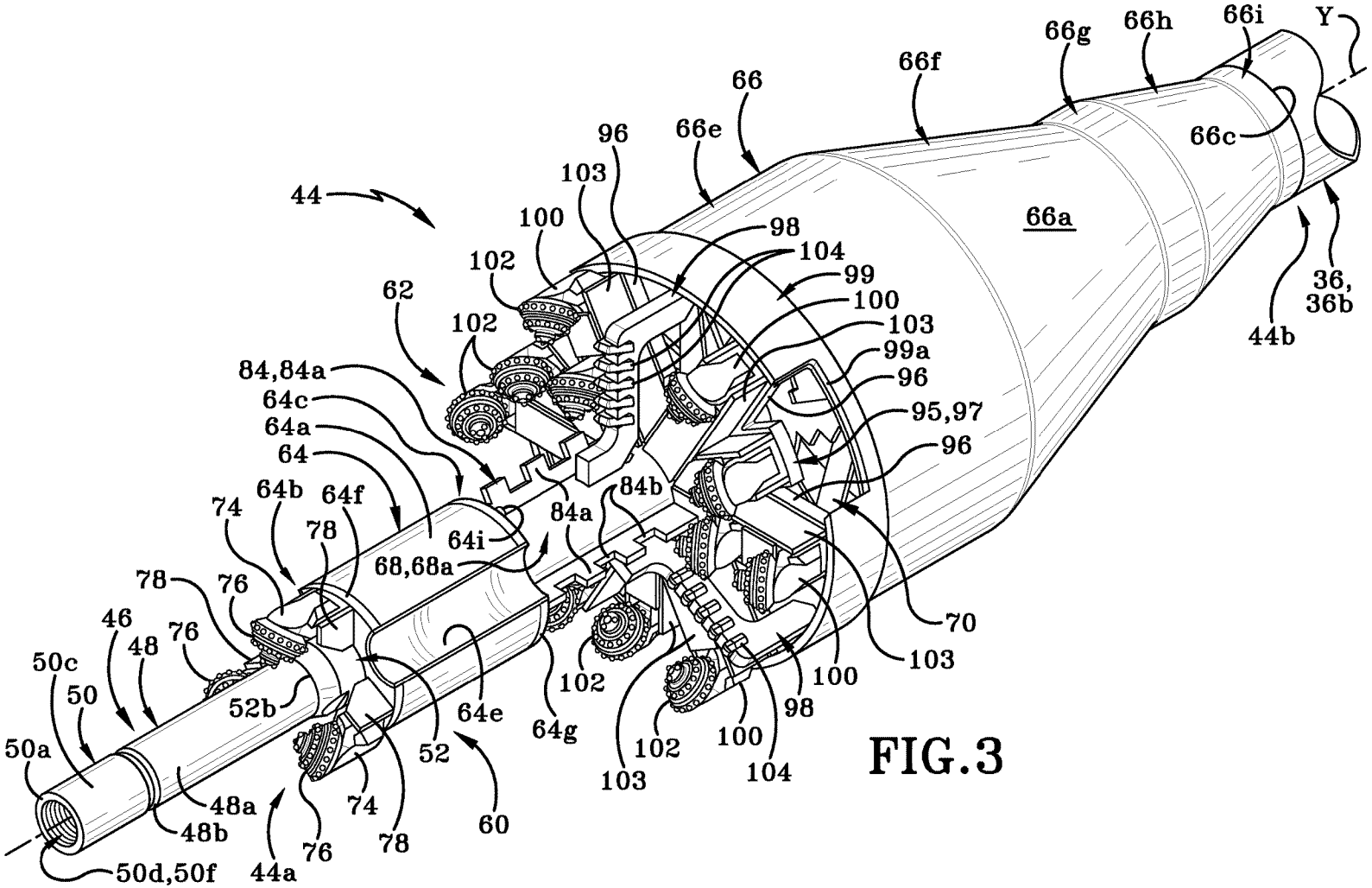
FIG. 3 is an enlarged perspective view of the cutting assembly in accordance with an aspect of the present invention.

FIG. 3 shows that a section of shaft 68 extends between first housing 64 and rear cutting head 62. A plurality of flanges 84 may extend radially outwardly from an exterior surface of the peripheral wall 68*a* of shaft 68. Each flange 84 may include a plurality of cuffing teeth 84*a* and recesses on its outermost end. Cutting teeth 84*a* aid in cutting through rock and soil that contact the exterior surface of this section of shaft 68. Teeth 84*a* also aid in further reducing a size of the cuttings produced by front cutting head 60 as those cuttings move rearwardly through fluted regions 64*e*.

Figure 4:
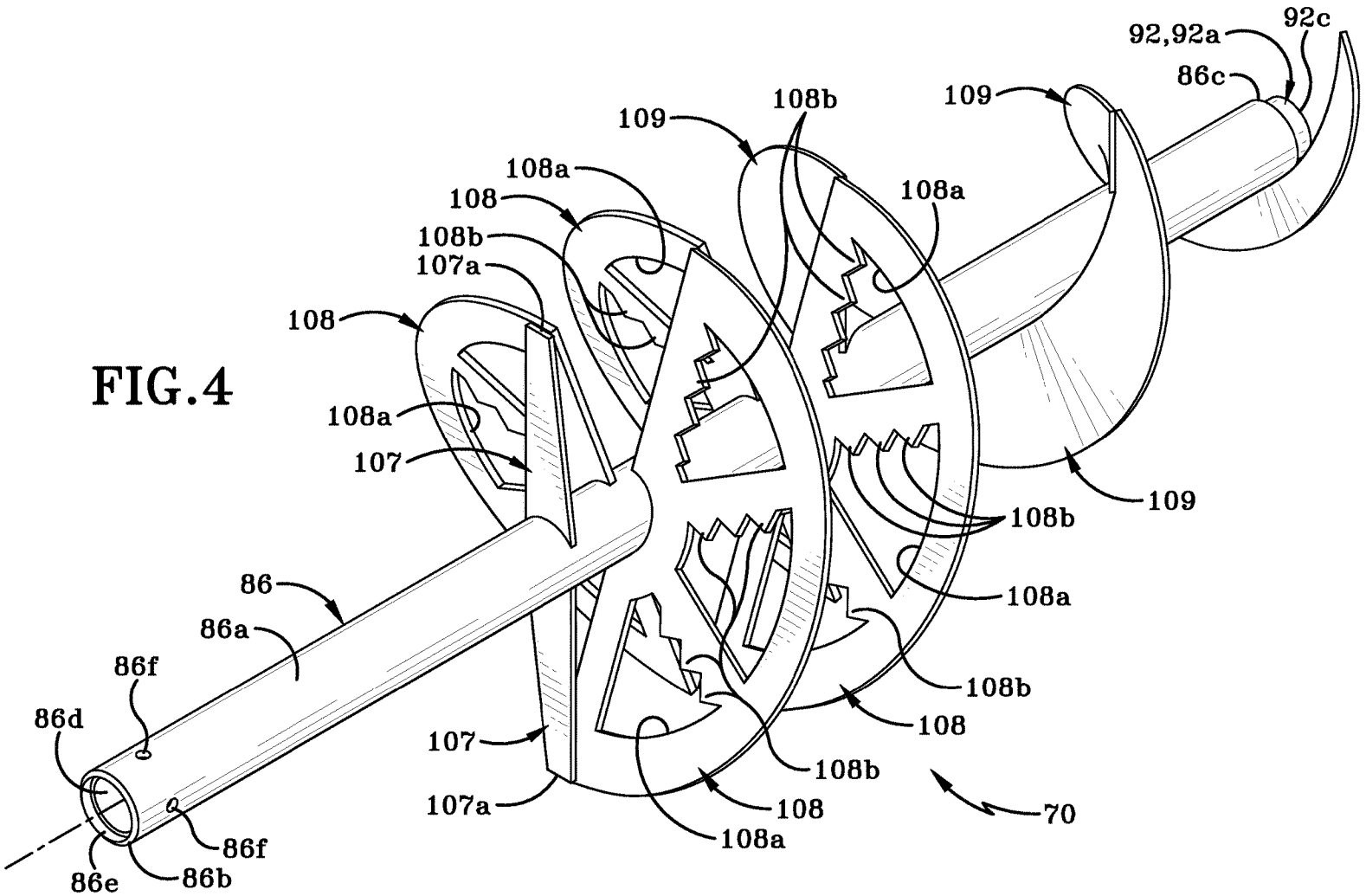
FIG. 4 is an isometric perspective view of an auger of the cutting assembly of FIG. 3.
Figures 5, 5A, 5B:
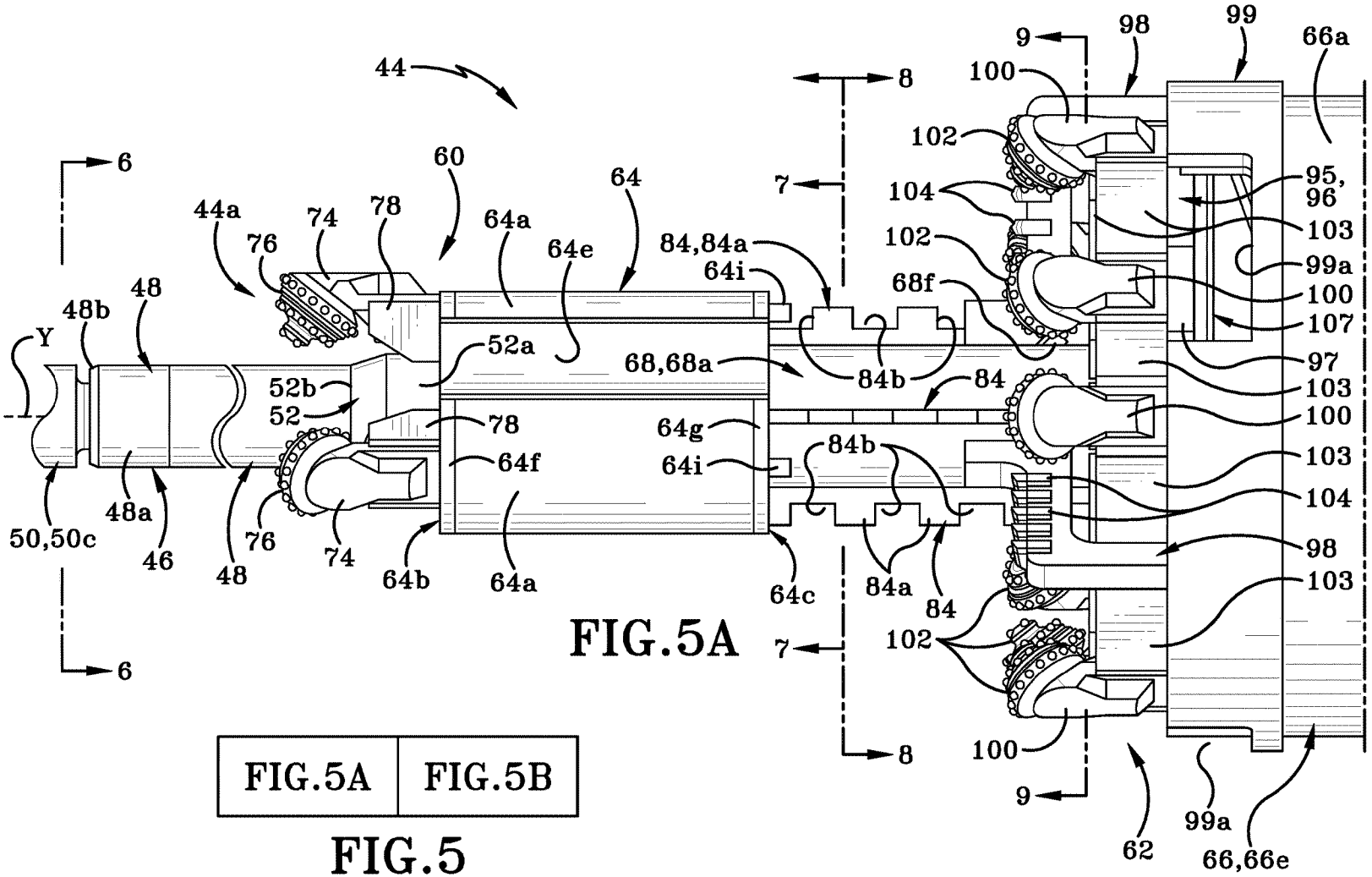
FIG. 5 is a block diagram showing that the components illustrated in FIG. 5A and FIG. 5B are oriented in a particular manner.
FIG. 5A is a side elevational view of the front end of the cutting assembly of FIG. 3 showing a front cutting head and a rear cutting head thereof.
FIG. 5B is a side elevational view of the rear end of the cutting assembly of FIG. 3 showing a housing that extends rearwardly from the rear cutting head and a casing that is engaged with the housing.
Figure 5B:
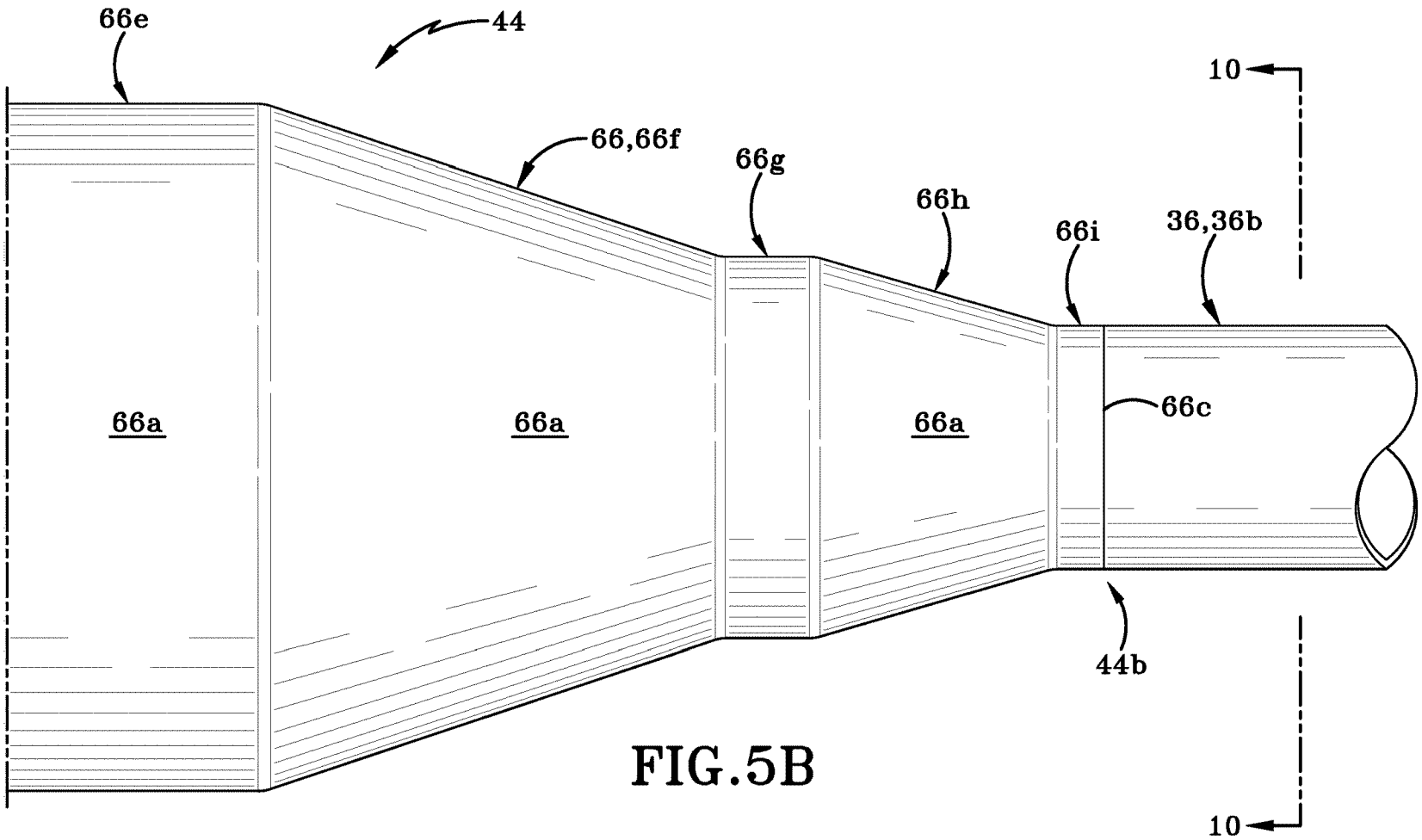

FIG. 4 shows auger 70 in greater detail. Auger 70 may comprise an auger shaft 86 upon which are engaged a plurality of flights 88*a*-88*d*. Auger shaft 86 may have a peripheral wall 88*a* with a front end 88*b* and a rear end 88*c*. Peripheral wall 88*a* may define a bore 88*d* that extends from front end 88*b* to rear end 88*c*. Auger shaft 86 may be of substantially constant diameter along its length as measured from front end 88*b* to rear end 88*c*. Front end 88*a* may an annular shoulder 88*e* that is configured to be complementary to annular groove 56*f* of connector sleeve 56. Auger shaft 86 is engaged with connector sleeve 56 in such a way that connector sleeve 56 and auger shaft 86 will move in unison as auger 70 is rotated in either of a first direction or a second direction about longitudinal axis "Y". The engagement between auger shaft 86 and connector sleeve 56 also places bore 86*d* of auger shaft 86 in fluid communication with bore 56*d* of connector sleeve 56 and thereby ultimately with the bore of pilot tube 20. It should be noted that the diameter of bore 86*d* is substantially the same as the maximum diameter of the flared section of bore 56*d* of connector sleeve 56. FIG. 11A shows that a plurality of holes 86*f* may be defined in peripheral wall 86*a* of auger shaft 86. Holes 86*f* may be aligned with first holes 68*e* in shaft 68. Holes 86*f* enable bore 86*d* of auger shaft 86 to be placed in fluid communication with bore 68*d* of shaft 68 and thereby with interior chamber 64*d* of first housing 64. Thus, interior chamber 64*d* of first housing 64 is placed in fluid communication with the bore of pilot tube 20.

FIG. 11B shows that bearings 90 are provided between an interior surface of peripheral wall 68*a* of shaft 68 and an exterior surface of peripheral wall 86*a* of auger shaft 86. Auger shaft 86 may therefore be able to be rotated independently of the rotation of shaft 68.

Figure 8:
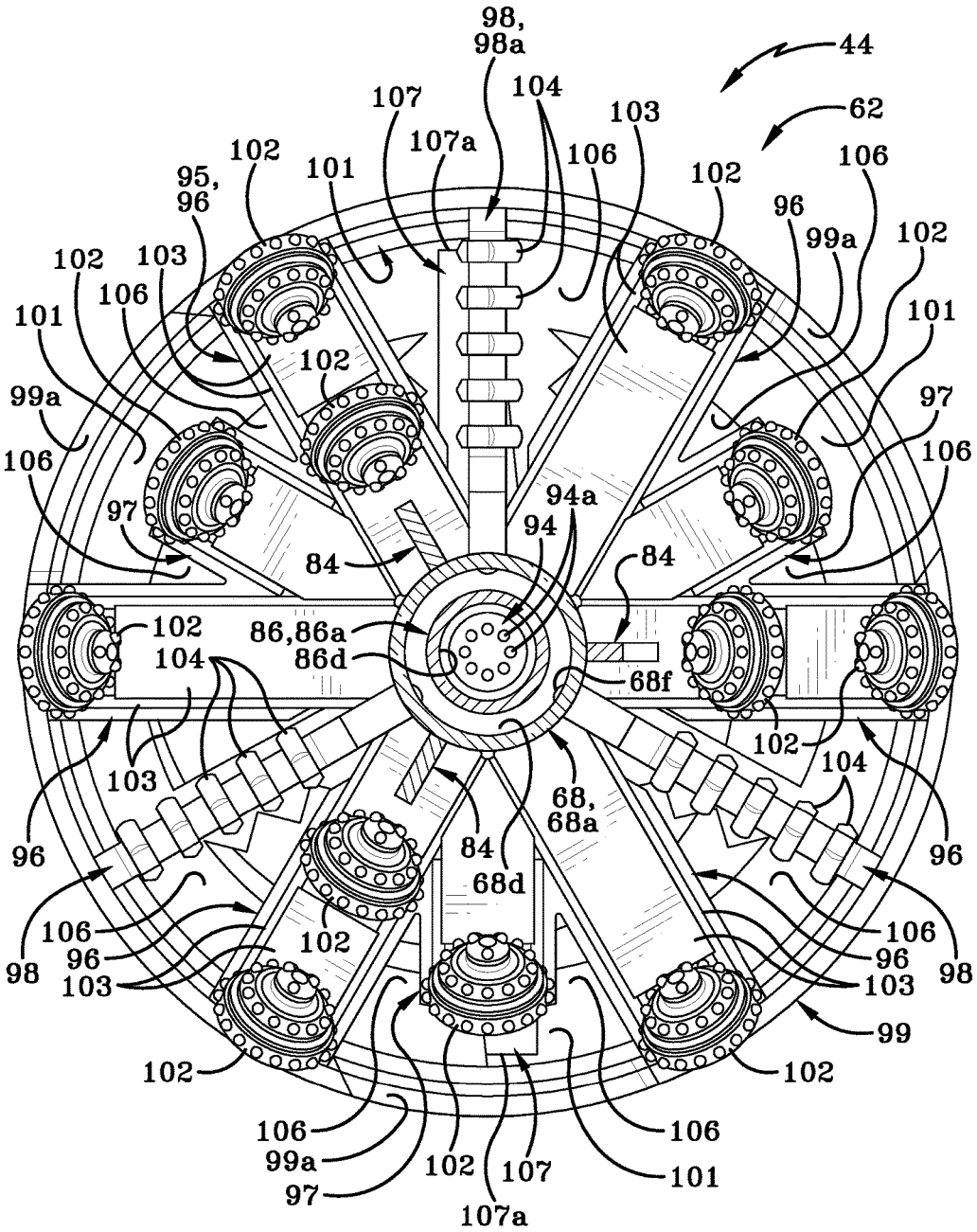
FIG. 8 is front end view of the rear cutting head taken along line 8-8 of FIG. 5A.
Figure 9:
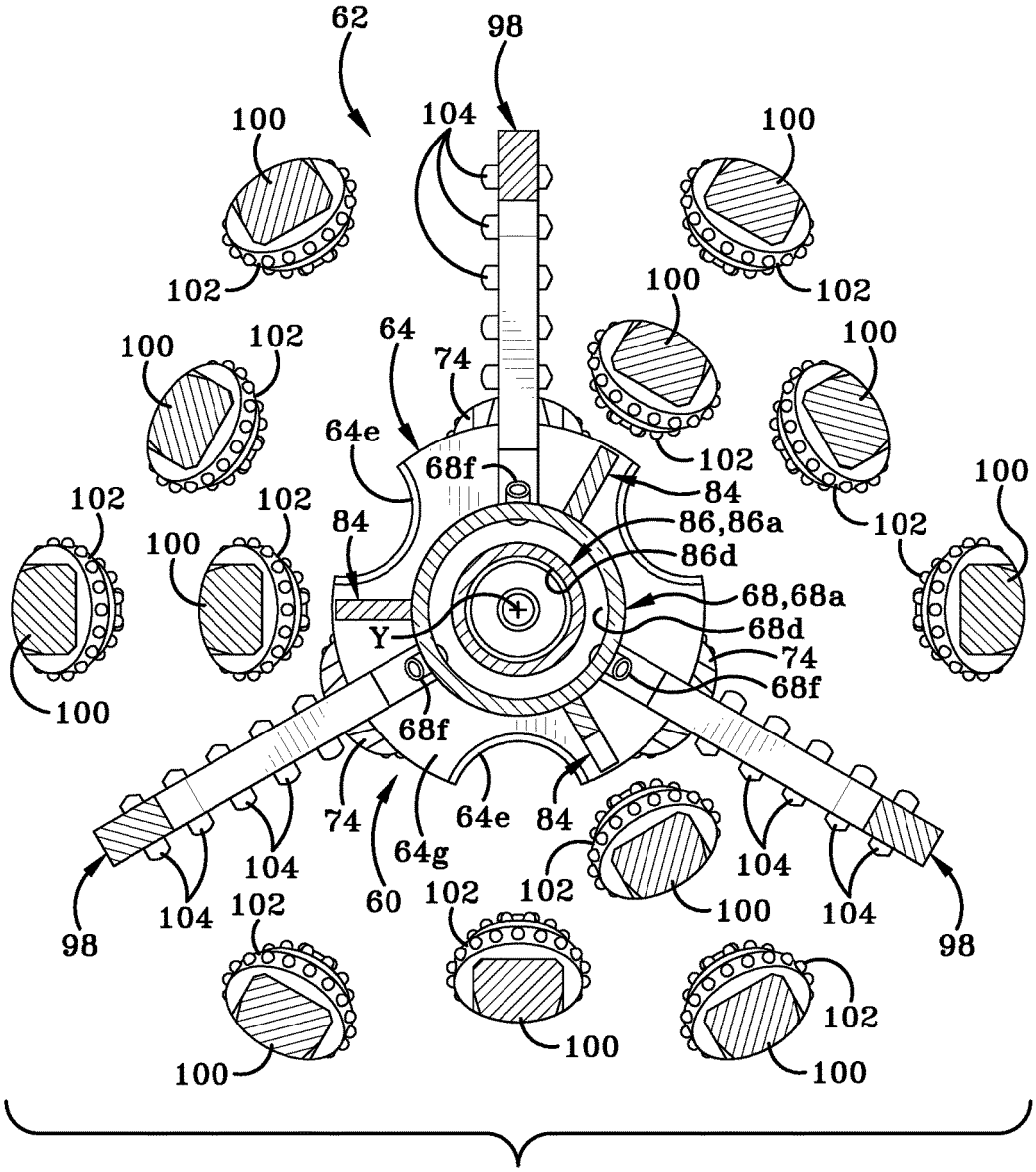
FIG. 9 is a rear end view of a middle region of the rear cutting head taken along line 9-9 of FIG. 5A.
Figure 10:
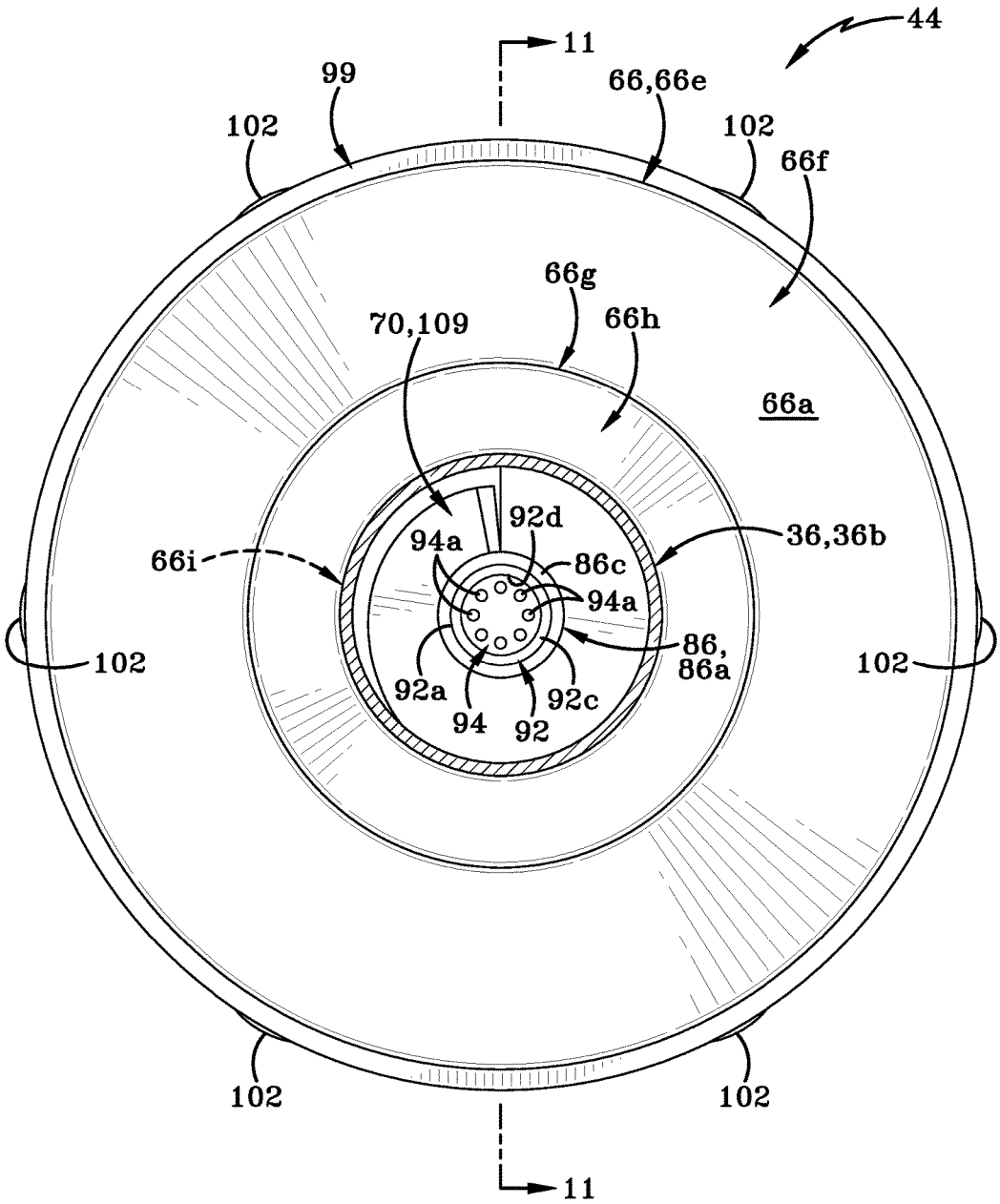
FIG. 10 is a rear end view of the housing of the cutting assembly taken along line 10-10 of FIG. 5B.
Figure 11C:
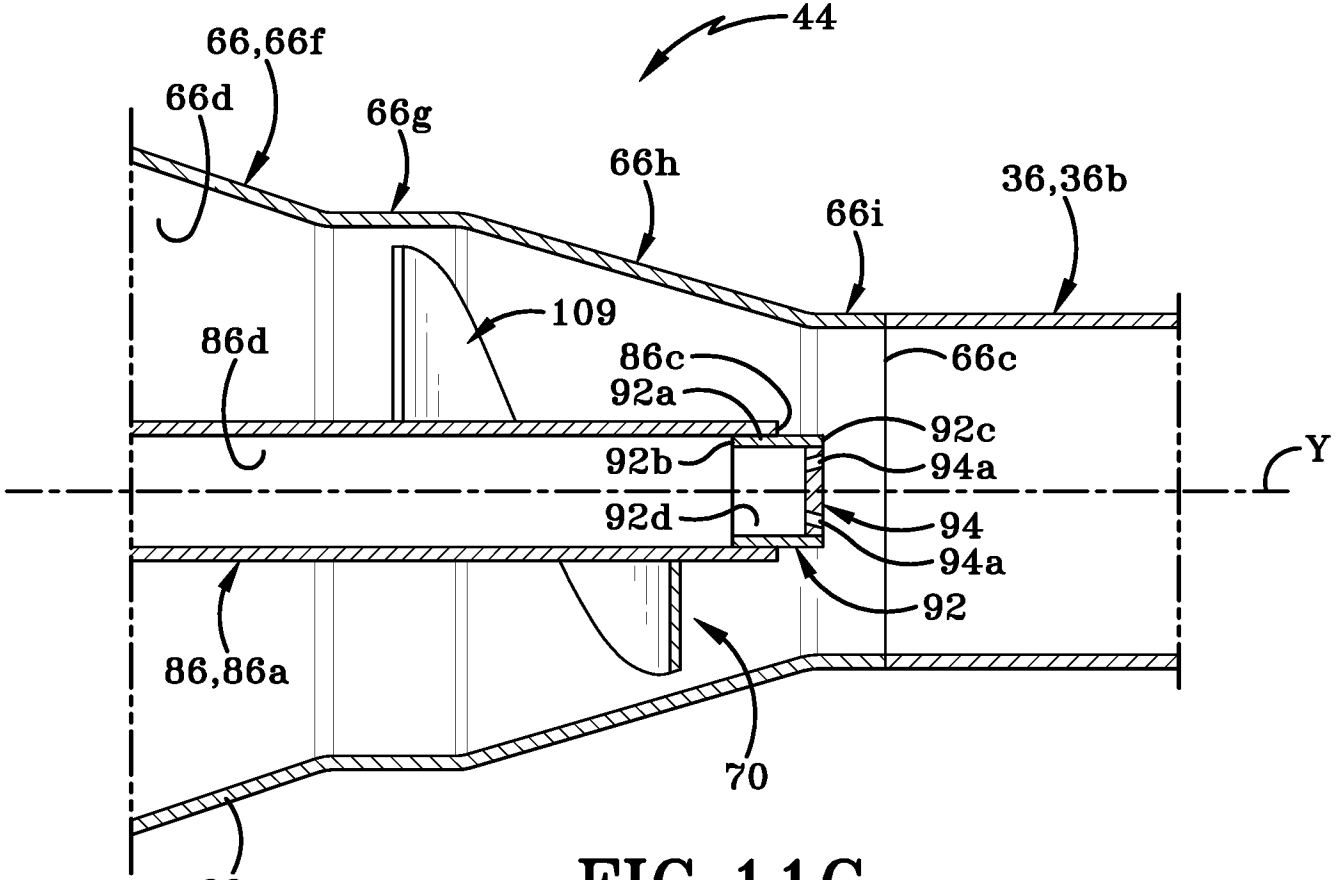
FIG. 11C is longitudinal cross-section through a rearward portion of the housing and the casing engaged therewith.

Referring to FIG. 11C, the rear end 86*c* of auger shaft 86 defines an opening therein and an insert 92 may be positioned in this opening and extending rearwardly of rear end 86*c*. Insert 92 may comprise a tubular peripheral wall 92*a* having a front end 92*b* and a rear end 92*c*. Peripheral wall 92*a* may define a bore 92*d* that is placed in fluid communication with bore 86*d* of auger shaft 86 when insert 92 is engaged with auger shaft 86. An end plate 94 may be engaged with insert 92 to limit fluid communication between bore 92*d* and an interior of a second housing 68 engaged with rear cutting head 62. End plate 94 may be a planar member that is generally circular in shape and defines a plurality of holes 94*a* therein. Holes 94*a* extend between an interior and exterior surface of plate 94 and allow air to flow out of bore 92*d* of insert 92. Plate 94 may be engaged with rear end 92*c* of insert 92 in such a way that the plate 94 may be removed and replaced from time to time. Furthermore, insert 92 may be engaged with auger shaft 86 in such a way that insert 92 may be removed and replaced from time to time. FIGS. 8 and 10 show a particular number of holes 94*a* arranged in an exemplary pattern but it should be understood that any desired configuration and number of holes 94*a* may be provided in plate 94. Holes 94*a* may be arranged in any pattern that is suitable for the particular terrain, rock and soil through which cutter assembly 44 is moving. A variety of different plates 94 that have different hole configurations or patterns may be selectively utilized in cutter assembly 44. In some instances, plate 94 may be an integral part of insert 92. In this latter instance, a plurality of inserts that have end walls in the same location as end plate 94 may be provided and the particular insert 92 with a particular selected pattern of holes 94*a* therein may be selected for use based on the cutting conditions and the nature of the terrain, rock or soil through which cutter assembly 44 must cut. It has been found that plates 94 having different patterns of holes 94*a* therein create different speed and pressure air and fluid flow from nozzles 64*i*, 68*f* and from holes 94*a*. The operator will select one of a plurality of differently configured plates to engage with cutting assembly 44. Each of these plates may differ in the number and pattern of holes 94*a* provided therein. After selecting an appropriate plate for the specific type of terrain through which cutting assembly 44 will bore, the operator will engage the appropriate plate 94 with insert 92.

Figure 12A:
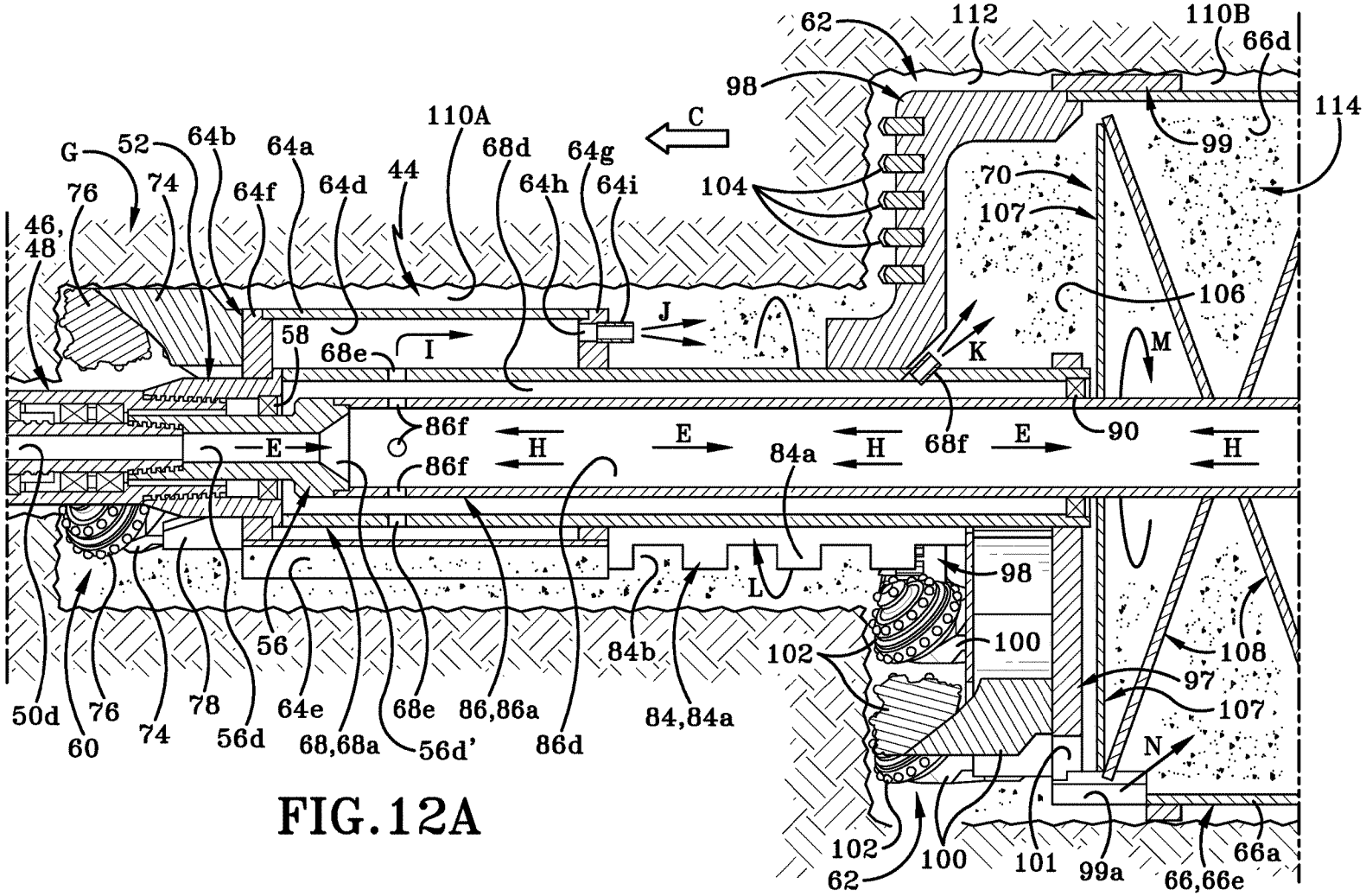
FIG. 12A is a longitudinal cross-sectional view of the front cutting head, the rear cutting head, central shaft and a front portion of the housing of the cutting assembly in operation and showing the flow of spoil through the cutting assembly.
Figure 12B:
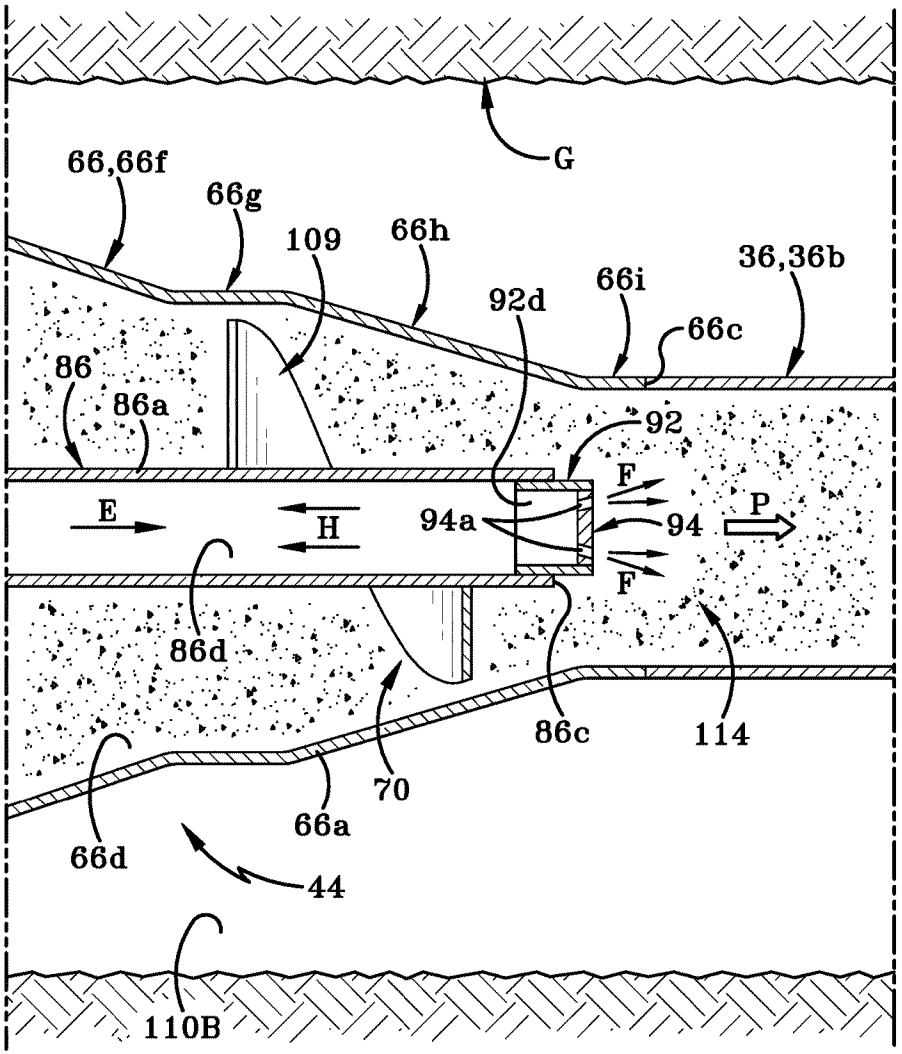
FIG. 12B is a longitudinal cross-sectional view of a rear portion of the housing of the cutting assembly in operation and showing the flow of spoil therethrough and into the casing engaged with the rear end of the cutting assembly.

Pressurized air may be caused to flow from the bore of pilot tube 20, through an air passage defined in swivel 46, through an air passage defined in cutter assembly 44 and through a bore defined in casing 36. The air passage through swivel 46 may comprise the air passage 50*d* of inner member 50 of swivel 46 and the bore 56*d* of connector sleeve 56. The air passage through cutting assembly may comprise the bore 86*d* of auger shaft 86, having an opening 86*e* at front end 86*b*. The holes 86*f* in auger shaft 86, the bore 92*d* of insert 92, the holes 94*a* in plate 94, the bore 68*d* of shaft 68, the first holes 68*e* and nozzles 68*f* of shaft 68; the bore 64*d* of first housing 64 and a bore 68*d* of second housing 68. Pressurized air from air compressor 22 may be caused to flow through swivel 46 and the air passage in cutting assembly 44 and into the bore of casing 36 in a first direction indicated by arrows "E" in FIG. 12A. Holes 94*a* in insert may allow some air to flow through bore 92*d* of insert 92 and to exit from bore 92*d*. The flow of exiting air is indicated by arrows "F" in FIG. 12B. The air flowing in the direction "F" entrains cut material and directs that material through bore 66*d* of second housing 66 and towards auger 70 and ultimately into and through the bore of casing 36. However, because there are solid regions on plate 94 that are located between the various holes 94*a* therein, a quantity of the air flowing through bore 92*d* of insert 92 in the direction "E" hits plate 94. This creates a back-pressure in bores 92*d* and 86*d* and the back-pressure is indicated by the arrows "H" in FIGS. 12A and 12B. The combination of air flow in the direction of arrow "E" and the back-pressure "H" causes air or fluid to be forced out of first holes 86*f* of auger shaft 86 and into bore 68*d* of shaft 68. Air subsequently flow out of bore 68*d* through first holes 68*e* and into bore 64*d* of first housing 64. This flow is indicated by arrow "I" in FIG. 12A. Air flows out of bore 64*d* of first housing 64 through nozzles 64*i* in the direction indicated by arrow "J" (FIG. 12A). This air flow picks up cuttings moving through fluted regions 64*e* produced by front cutting head 60 and causes those cuttings to move rearwardly towards rear cutting head 62.

Air flowing through bore 68*d* of shaft 68 also flows rearwardly and outwardly through nozzles 68*f* and into the region located rearwardly of rear cutting head 62. This air flow is indicated by arrows "K' in FIG. 12A. The air flow "J" entrains material cut by front cutting head 60 and directs that material rearwardly towards rear cutting head 62. The air flow "K" entrains material cut by rear cutting head 62 and directs that material rearwardly through bore 66*d* of second housing 66 towards auger 70 and towards the bore of casing 36.

Referring to FIGS. 6, 8 and 11B, rear cutting head 62 extends outwardly and forwardly from second housing 66. Second housing 66 includes a peripheral wall 66*a*, a front end 66*b*, a rear end 66*c* and a bore 66*d* defined by an inner surface of wall 66*a* and extending from front end 66*b* to rear end 66*c*. As is evident from FIG. 2A, second housing 66 tapers progressively from proximate collar 99 to where rear end 66*c* of second housing 66 connects to casing 36 and includes a widest diameter first region 66*e*, a tapering diameter second region 66*f*, a substantially constant diameter third region 66*g*, a tapering diameter fourth region 66*h*, and a substantially constant diameter fifth region 66*i* that terminates in rear end 66*c*. Fifth region 66*i* may comprise a collar that is configured to mate with a casing segment, such as segment 36*b* that is secured to the rear end 66*c* of second housing 66. Annular collar 66*i* is engaged with rearmost portion of second housing 66. The collar of fifth region 66*i* may help to rigidly secure second housing 66 to casing segment 36*b*. The collar 66*i* may threadably engage casing segment 36*b* or may be welded thereto or may be connected by a plurality of fasteners (not shown) such as bolts or screws to casing segment 36*b*. (Similar collars and fasteners may be used between adjacent pairs of casing segments 36 to secure a given front end of one segment 36 to a given rear end of another segment 36, whereby such collars may be used to secure segments 36 in the end-to-end fashion shown in FIG. (1B). The engagement of casing 36 with second housing 66 places bore 66*d* of second housing 66 in fluid communication with the bore of casing 36.

Rear cutting head 62 may comprise a plurality of legs 96 and 97 that extend radially outwardly and forwardly from an end plate 95 (FIGS. 8 and 11B). Legs 96 and 97 may both have arms 100 that are engaged therewith and which extend outwardly and forwardly away from end plate 95. A series of plates 103 may be welded to end plate 95 and legs 96, 97, 99 for strength and rigidity and to secure legs to end plate 95. A roller cone 102 may be provided on each arm 100. FIG. 6 shows that legs 96 and 97 may differ in length. Legs 96 may extend outwardly from shaft 68 all the way to an annular collar 99 that is provided on second housing 66 or as part of rear cutting head 62. Collar 99 may overlap a front end 66*b* of peripheral wall 66*a* of second housing 66. Collar 99 and sidewall 66*a* may define an opening 99*a* (FIG. 5A) therein that helps cut material to flow into an interior of cutter assembly 44 in the direction of arrow "N" (FIG. 12A) as will be later described herein. It should be noted that the roller cones 102 located proximate the outer perimeter of rear cutting head 62 will cut through the ground "G" to create a borehole 110B (FIG. 10) that is slightly larger than the exterior diameter of collar 99 and is larger than an exterior diameter of sidewall 66*a* of second housing 66. Collar 99 may have a diameter greater than or substantially equal to the diameter of the rear cutter head 62; where the diameter of the rear cutter head extends from an outermost region of one roller cone 102 to an outermost region of an opposed roller cone 102. Consequently, collar 99 may be substantially in direct contact with the surrounding ground and soil that defines borehole 110B that is cut by rear cutting head 62. A gap 112 (FIG. 10) may be defined between the ground and soil that defines borehole 110B and the exterior surface of sidewall 66*a*. Collar 99 is thus adapted to effectively "seal" the borehole 110B and substantially prevents debris cut during boring operations with cutting assembly 44 from moving forwardly beyond rear cutting head 62. In other words, collar 99 may aid in preventing frac-out by sealing borehole 110B. Collar 99 may be welded or otherwise secured to second housing 66 so that collar 99 and second housing 66 rotate in unison with rear cutting head 62 and shaft 68.

Legs 96 of rear cutting head 62 may be fixedly engaged with an exterior surface of shaft 68 and collar 99. Some of the legs 96 may be provided with a single arm 100 and roller cone 102 thereon. Other of the legs 96 may be provided with more than one arm 100 and roller cone 102 thereon. In particular, the legs 96 illustrated herein may have either one or two arms 100 and roller cones 102 thereon.

Legs 97 of rear cutting head 62 on the other hand may be engaged with shaft 68 at one end but terminate a distance away from collar 99. Consequently, a gap 101 may be defined between collar 99 and a terminal end 97*b* of each leg 97. The ends of legs 97 and gaps 101 may be directly adjacent openings 99*a* in collar 99 and peripheral wall/66*a* (FIGS. 6 & 8). Each leg 97 may have a single arm 100 thereon with a single roller cone 102 thereon.

Legs 98 of rear cutting head 62 may extend outwardly from shaft 68 to collar 99 and be fixedly engaged to each of the shaft 68 and collar 99. Legs 98 may be substantially "S"-shaped when viewed from the side such as in FIG. 11B. A plurality of cutting teeth 104 may be provided on a section each leg 98 that is oriented generally at right angles to longitudinal axis "Y" of cutting assembly 44. Cutting teeth 104 may be oriented at right angles to the length of each leg 98, where the length is measured from shaft 68 to collar 99.

It should be noted that the positioning and type of legs 96, 97, 98 may be such that there are three arms 98 oriented at about 60° relative to each other. This can be seen best in FIG. 9. There may also be three legs 97 oriented at about 60° relative to each other but offset from the three legs 98. There may also be three legs 96 that include a single roller cone 102 thereon that are oriented at about 60° relative to each other; but again, offset from the legs 98 and 97. Finally, there may be three legs 96 that include two roller cones 102 thereon that are oriented at about 60° relative to each other but offset from the other legs.

Figure 6A:
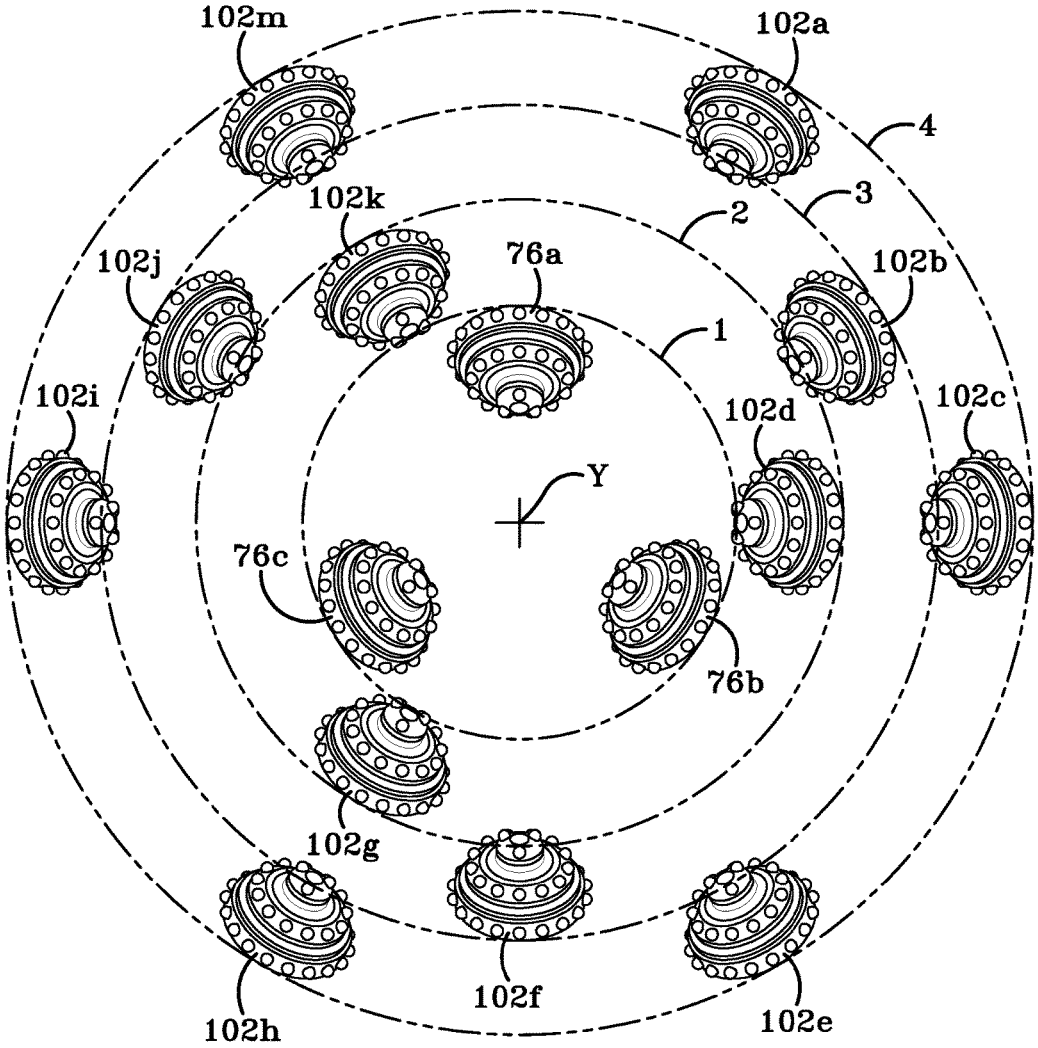
FIG. 6A is a front end view of only the roller cones of the front and rear cutting heads showing that the overlap between the concentric rings of roller cones in the cutting assembly.
Figure 7:
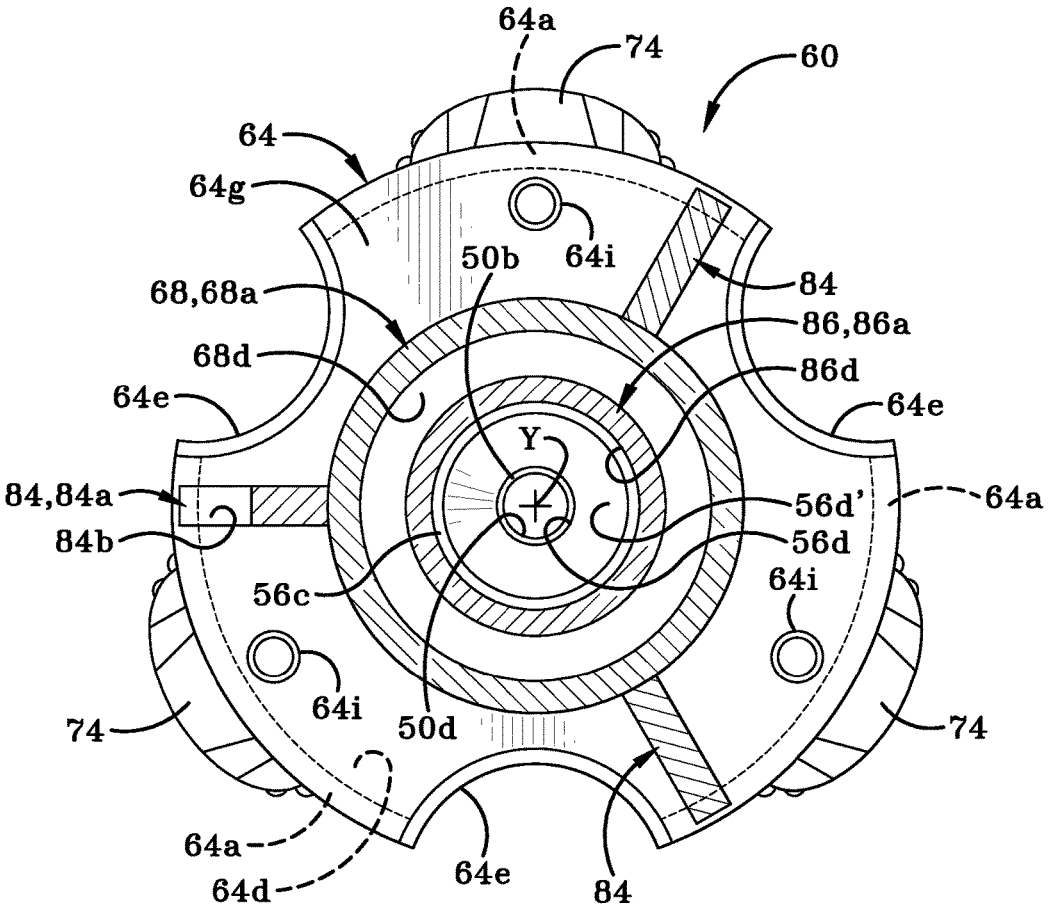
FIG. 7 is a rear end view of the front cutting head taken along line 7-7 of FIG. 5A.

FIGS. 6 and 6A show that the legs 96, 97, and 98 may be oriented as though they mark the hours on an analog clock. As illustrated in these figures a first leg 98*a* may be located at a "12-o'clock" position; a first leg 96*a* may be located at a "1-o'clock" position, a first leg 97*a* may be located at a "2-o'clock" position, and so on. In total, there may be twelve legs that are located at the hour positions on a analog clock. It should be noted that in the particular configuration illustrated in these figures, first leg 98*a* may have cutter teeth 104 thereon and be radially aligned with one of the arms 74 on front cutting head 60. Consequently the roller cone 76*a* (FIG. 6) on that arm 74 appears to be on an innermost end of first leg 98*a* when seen from the front. First leg 96*a* may be offset from first leg 98*a* and be offset from the arm 74 that includes roller cone 76*a*. First leg 96*a* may include an arm 100 with a roller cone 102*a* thereon. It should be noted that this roller cone's perimeter may extend marginally further outwardly than an outer surface of collar 99. The opening or cut-out region 99*a* may be defined in collar 99 to allow material to flow inwardly into second housing 66. This can best be seen in FIG. 10. First leg 97*a* may include only a single roller cone 102*b* thereon. It should be noted that roller cone 102*b* may be located at a distance away from shaft 68 that falls between the distance of the roller cone 102*a* from roller cone 76*a*. The second arm 96*b* (which is at the "3-o'clock" position) may include two roller cones 102*c*, 102*d*. It should be noted that roller cone 102*b* may be located between roller cones 102*c* and 102. Roller cone 102*d* may be the same distance from shaft 68 as is roller cone 102*a*.

FIG. 6A shows the roller cones only and their relative "orbits" (or radial distances) relative to longitudinal axis "Y". Roller cones 76*a*, 76*b*, 76*c* are in a first orbit, identified by the reference number "1". Each of these roller cones 76*a*, 76*b*, 76*c* is provided on front cutting head 60. Roller cones 102*d*, 102*g*, and 102*k* are in a second orbit, identified by the number "2". Roller cones 102*b*, 102*f*, 102*j* are all in a third orbit, identified by the number "3". Roller cones 102*a*, 102*c*, 102*e*, 102*h*, 102*i*, and 102*m* are all in a fourth orbit, identified by the number "4". Each group of roller cones slightly overlaps the orbits adjacent to its own orbit. For example, the roller cones 76*a*, 76*b* and 76*c* are in orbit "1" but slightly overlap orbit "2". The roller cones 102*b*, 102*f*, 102*j* are in orbit "3" but slightly overlap orbit "2" and orbit "4". This arrangement of the roller cones ensures that as the cutter assembly 44 cuts through the ground, each and all of the soil or rock located from adjacent shaft 68 outwardly to collar 99 will tend to be cut away by one of the roller cones as the cutter assembly 44 rotates. There will tend not to be small "islands" of uncut rock and soil left behind the cutter assembly 44 because of this configuration of roller cones.

Since each leg 96, 97, 98 may be positioned in generally the same location as the hour markings on an analog clock face, gaps may be defined between adjacent legs 96, 97, 98. These gaps are identified in FIG. 6 by the reference number 106. The gaps 106 are provided to allow cut material (i.e., cuttings or spoil or discharge) to move rearwardly out of the way of the cutter assembly 44 as it moves forward through the terrain. As will be explained later herein, the cut material is moved rearwardly by a combination of the forward and rotational movement of cutter assembly 44 and air pressure from air compressor 22 that entrains the cut material therein as the air flows through the air passage defined in the cutter assembly 44 and into and through the casing 36 to where those cuttings will be discharged through hose 42 and into second pit 14. It should be noted that the air passage may comprise a first air passage that is defined in the front cutting head 60 and a second air passage that is defined in the rear cutting head.

Referring once again to FIG. 4, auger 70 further comprises a pair of blades 107 that extend outwardly from the exterior surface of peripheral wall 86*a* of auger shaft 86, a distance rearwardly of the front end 86*b*. Blades 107 are opposed to each other and taper from a region where they join peripheral wall 86*a* to where they terminate at a truncated tip 107*a*. Blades 107 aid in further cutting material i.e., reducing the size of cuttings entering bore 66*d* of second housing 66.

Rearwardly of blades 107, a series of angled grinding plates 108 may be provided on auger shaft 86 and rearwardly of grinding plates 108 there is a plurality of auger flights 109 that are arranged in a helix around the exterior surface of auger shaft 86. Auger flights 109 extend outwardly away from the exterior surface of auger shaft 86. Grinding plates 108 may be of the largest size towards front end 86*b* of auger shaft 86 and may get progressively smaller moving toward rear end 86*c* thereof. Auger 70 may located substantially within bore 66*d* of second housing 66 and a portion of auger shaft 86 may extend outwardly and forwardly from bore 66*d*. Blades 107 and grinding plates 108 may be located entirely within bore 66*d* of second housing 66.

In accordance with an aspect of the present invention, one or more of the grinding plates 108 may define one or more holes 108*a* therein that extend from a front surface of the flights to the rear surface thereof. As best seen in FIG. 11B, grinding plates 108 may be oriented at a variety of different angles relative to auger shaft 86. In accordance with another aspect of the invention, an inner surface may extend between the front surface and rear surface of each flight 108*a* and the inner surface may bound and define the associated hole 108*a*. Inner surface may include a plurality of jagged teeth 108*b* that extend inwardly into the hole 108*a* in the plane of the flight 108. Holes 108*a* may allow some cuttings to pass therethrough and the jagged teeth provided on the flight 108 may further cut up the material that is being fed rearwardly by the auger 70. In other words, teeth 108*b* may further reduce the size of the cuttings moving through second housing 66. Connecting plates 108*c* (FIG. 11B) may be provided to connect one grinding plate 108 to another.

With primary reference to FIGS. 1A, 1B and 10, the operation the system is now described. As shown and discussed previously with respect to FIG. 1, pilot tube 20 may be used to form pilot hole 18. This may be done in any manner known in the art. Pilot hole 18 may be formed by forcing and/or drilling with pilot tube 20 from first pit 12 to second pit 14 or in the opposite direction from second pit 14 to first pit 12. Thus, rig 28 of control assembly 16 might be used to drive pilot tube 20 from first pit 12 to second pit 14, or rig 30 may be used to drive pilot tube 20 from second pit 14 to first pit 12. As is well-known in the art, this would be done by adding pilot tube segments 20*a*, 20*b*, 20*c*, etc. in an end-to-end fashion as the pilot hole 18 becomes longer. Once pilot tube 20 has formed pilot hole 18, such that one end of pilot tube 20 is exposed at first pit 12 and the other end exposed at second pit 14, the end exposed at second pit 14 is engaged with front end 50*a* of swivel 46. The other end of the pilot tube 20 that is exposed at first pit 12 is engaged with the conduits 26 that connect to air source 22 and water supply 24. Cutting assembly 44 may be rotated about longitudinal axis "Y" in a first direction ""L" to advance the assembly 44 in the direction of arrow "C" and pilot tube 20 and auger 70 may be rotated in the opposite direction "M" (FIG. 1B and FIG. 12A) to move the cut material 114 (FIG. 12A) in a direction opposite to arrow "C". In other instances, pilot tube 20 and auger 70, may be rotated in the same direction as the rotation of cutting assembly 44 (i.e., in the direction of arrow "L" or the opposite direction to arrow "M") and thereby move the cuttings, spoil or debris 114 in a direction opposite to arrow "C" (FIG. 1). It should be noted that pilot tube 20 and auger 70 may be rotated at a same speed as cutting assembly 44 or at a different speed (higher or lower) to the speed of rotation of the cutting assembly 44.

The swivel 46 will be engaged with swivel mount 52 on cutting assembly 44. Second housing 66 of cutting assembly will also be engaged with the forwardmost casing segment 36*b* and one or more casing segments 36 may be secured to casing segment 36*b* to engage cutting assembly 44 to engine 34. Engine 34 of rig 30 may be operated to drive rotation of a drive shaft that is operatively engaged with casing segment 36*a*. Air compressor 22 is actuated in first pit 12 so that pressurized air flows through conduits 26, through the bore of pilot tube 20, through air passage 50*d* of swivel and into the air passage of cutting assembly 44. The airflow may be in the range of from about 900 cfm up to about 1600 cfm or even higher to be effective at entraining cuttings from cutting assembly 44.

It will be understood that in some instances it may be desirable to utilize water or other fluids to discharge cuttings from cutting assembly 44 through casing 36 instead of air. In this instance, water supply 24 will be actuated in first pit 12 so that pressurized water or any other suitable fluid flows through conduits 26, through the bore of pilot tube 20 and into the air passage of cutting assembly 44.

As cutting assembly 44 is rotated (in the direction of arrow "L"—FIG. 12A) about the longitudinal axis "Y" by engine 34 and is advanced forwardly in the direction of arrow "C" (FIG. 1B), roller cones 76 of front cutting head 60 cut and break up the ground "G". Cut materials are fed rearwardly by rotating roller cones 76, arms 74 and plates 78 through fluted regions 64*e* in first housing 64 to the region rearwardly of the first housing 64. At this point cutting assembly 44 is rotating about the longitudinal axis "Y" and is still advancing in the direction of arrow "C" through ground "G". Front cutting head 60 cuts a first diameter borehole through ground "G".

Air flowing through the air passage in cutting assembly 44 blows cuttings toward shaft 68 with flanges 84 and cutting teeth 84*a* thereon and towards rear cutting head 62. Roller cones 102 and cutting teeth 104 cut and grind away additional material, thereby enlarging the diameter of the borehole cut by front cutting head 60. Cuttings from rear cutting head 62 pass through the gaps between the various arms 96, 97, and 98 of rear cutting head 62 and into bore 66*d* of second housing 66. Engine also actuates auger 70 to rotate independently in either of the same direction as the rotation of the rest of cutting assembly or opposite thereto. Grinding plates 108 of auger 70 feed the cuttings rearwardly through bore 66*d* towards casing 36. Some cuttings pass through the openings 108*a* grinding plates 108 and are further reduced in size by contacting the cutting teeth 108*b* as auger 70 is rotated. Finally, through the action of the pressurized air flowing through the air passage in cutting assembly 44 and the action of auger 70, cuttings from front and rear cutting heads 60, 62 enter the bore of casing 36. Since all of the casing segments 36*b*, 36*c*, 36*d* through to the rearmost casing segment 36*a* have bores that are in fluid communication with each other, the cut material (i.e., the spoil) entrained in the pressurized air blowing out of cutting assembly 44 will feed into casing 36, and finally out of discharge port 40 on HDD rig 30.

Since the spoil flowing through second housing 66 moves directly into casing 36, there is a substantially reduced chance of frac-out when this system is used. Furthermore, since collar 99 acts as a sealing surface and effectively substantially seals the borehole 1108 that is cut in the ground "G", any cuttings, air and/or fluid that might inadvertently escape from casing 36 cannot flow forwardly and thereby be accidentally forced toward the surface as the cutting assembly 44 advances in the direction of arrow "C" through ground "G". The sealing collar 99 also aids in preventing air or fluid used during the boring operation from leaking into the environment and potentially damaging and contaminating the same. The collar 99 also ensures that the air or fluid that is forced through the air passage through front and rear cutting heads 60, 62 is under sufficient pressure to force cuttings through second housing 66 and into casing 36 to move the cuttings therethrough. If air and/or fluid can bleed around collar 99, then the pressure on the cuttings will be reduced and might be insufficient to move the cuttings through the second housing 66, through the casing 36 and out of the discharge port 40 and hose 42.

A method of generally horizontally boring a borehole 1108 (FIG. 12A) may comprise steps of providing a cutting assembly 44 comprising a front cutting head 60 and a rear cutting head 62; wherein rear cutting head 62 is spaced a distance rearwardly behind front cutting head 60; rotating in the direction of arrow "L" (FIG. 12A) and moving forward in the direction of arrow "C", the cutting assembly 44 and a casing 36 extending rearwardly from cutting assembly 44 to cut an underground borehole 110; and moving pressurized air in the direction of arrow "E" rearwardly through an air passage 86*d*, 86*f*, 68*d*, 68*e*, 68*f*, 64*d*, 64*h*, 64*i*, 66*d* in front cutting head 60 and rear cutting head 62, including the space between front cutting head 60 and rear cutting head 62 and subsequently into a bore defined in casing 36 to discharge cuttings created by the front and rear cutting heads 60, 62 in a direction "P" (FIG. 12B) and out of rear end 36*a*, 40, 42 (FIGS. 1A, 1B) of casing 36.

The method may further comprise a step of driving the rotation of the cutting assembly 44 and of the casing 36 in the direction of arrow "L" (FIG. 12B) with a rotational output of an engine 34 adjacent the rear end 36*a* of casing 36. The step of rotating in the direction of arrow "L" and moving forward cutting assembly 44 and casing 36 in the direction of arrow "C" comprises pushing the rear end 36*a* of the casing 36 in the direction of arrow "C".

The method further comprises a step of providing a pilot tube 20 within an underground pilot hole 18 having a pilot hole diameter that is slightly larger than a diameter of the pilot tube; wherein the borehole 110A, 110B follows the pilot hole 18 and has a first borehole diameter (cut by the front cutting head 60) and a second borehole diameter (110B that is cut by the rear cutting head 62) that is larger than the pilot hole diameter. The method further comprises a step of engaging the cutting assembly 44 and pilot tube 20 together in end-to-end relationship via a swivel 46. This engagement causes pilot tube 20 to be rotatable in the same direction as the cutting assembly or the opposite direction relative thereto or at a same speed or a different speed relative to the cutting assembly that rotates in the direction of arrow "L".

The method further comprises engaging the pilot tube 20 with a front end 68*b* of a shaft 68 of cutting assembly 44 (FIG. 1B) via swivel 46 and placing a bore of the pilot tube 20 in fluid communication with bore 86*d* of auger shaft 86 and bore 68*d* of shaft 68; and moving pressurized air from air source 22 through conduits 26, through the bore of pilot tube 20 into bore 86*d* and bore 68*d* of shaft 68.

The step of moving pressurized air through the bore 86*d* of auger shaft 86 further comprises creating backpressure in the direction of arrow "H" (FIG. 12A). The step of creating backpressure in the direction of arrow "H" comprises engaging a plate 94 defining a pattern of holes 94*a* therein at a rear end 86*c* of bore 86*d* of auger shaft 86. The step of creating backpressure further comprises engaging one of a plurality of different plates 94 at rear end 86*c* of the bore 86*d* of auger shaft 86, wherein each of the plurality of different plates, such as plate 94, defines a different pattern of holes 94*a* therein. An exemplary pattern of holes 94*a* may be seen in FIG. 8, though other patterns are possible. The plate 94 that is engaged with auger shaft 86 is selected by an operator based on a particular pattern of holes 94*a* arranged in the selected plate 94. The pattern of holes 94*a* in any particular plate 94 is selected on the basis of the terrain (i.e., type of rock, soil, ground, obstacles, etc.) through which borehole 110B is to be cut as the pattern of holes 94*a* will affect the strength of the backpressure generated within shaft 68. If a strong airflow is required to blow heavier, larger particle cuttings through the cutting assembly 44, through casing 36 and out of discharge port 42, then a first configuration or pattern of holes 94*a* in plate 94 will be selected. If a less vigorous airflow is required to blow cuttings (such as smaller, lighter particles like beach sand) through cutting assembly 44 and casing 36 and out of discharge port 42, then a plate 94 with a completely different pattern of holes 94*a* may be selected.

The method further comprises sealing the borehole 110B with a collar 99 provided rearwardly of rear cutting head 62 on cutting assembly. The method further comprises providing a rearwardly tapered second housing 66 (FIGS. 12C and 12B) rearwardly of rear cutting head 62 and attaching casing 36 to a rear end 66*e* of the tapered second housing 66; and directing cuttings from rear cutting head 62 through bore 66*d* defined by the tapered second housing 66 and into casing 36. This directing of cuttings is accomplished by additionally using an auger provided in cutting assembly 44.

The method further comprises cutting a first diameter borehole 110A with front cutting head 60 and cutting a larger second diameter borehole 110B with rear cutting head 62 and performing this cutting operation without withdrawing the cutting assembly 44 from the borehole 110A, 110B between the cutting of the first diameter borehole 110A and the cutting of the second diameter borehole 110B. In other words, the cutting of the two different diameter sections 110A, 110B of the borehole is accomplished in a single pass of cutting assembly 44.

The step of moving pressurized air through cutting assembly 44 occurs essentially without moving a liquid rearwardly through the air passage in cutting assembly 44 and into casing 36.

Furthermore, the step of rotating in the direction of arrow "L" and moving forward in the direction of arrow "C" occurs without delivering a liquid adjacent the cutting assembly 44 other than liquid occurring naturally in the ground through which cutting assembly 44 cuts borehole 110A, 110B. Additionally, wherein other than liquid occurring naturally in ground through which cutting assembly 44 cuts the borehole 110A, 110B, essentially no liquid is used to discharge from the borehole 110A, 110B cuttings created by cutting assembly 44.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A cutting assembly for drilling a borehole, said cutting assembly comprising:

a front cutting head of a first diameter;

a rear cutting head of a second diameter, wherein the second diameter is greater than the first diameter;

a shaft operatively engaging the front cutting head to the rear cutting head; wherein said rear cutting head is located rearwardly of the front cutting head along the shaft; and wherein the front cutting head, the rear cutting head and the shaft are rotatable in unison about a longitudinal axis of the shaft in a first direction;

an air passage defined in the cutting assembly; said air passage adapted to be operatively engaged with a remote air source located forwardly of the cutting assembly and with a bore of a casing located rearwardly of the cutting assembly; wherein pressurized air from the remote air source flows through the air passage and entrains cuttings produced by the front cutting head and the rear cutting head and directs the cuttings into the bore of the casing;

an auger that is concentric with the shaft, said auger being selectively rotatable in either of the first direction or a second direction about the longitudinal axis of the shaft; wherein the auger is rotatable independently of the front cutting head, the rear cutting head and the shaft; wherein the auger comprises an auger shaft having a front end and a rear end and a plurality of flights arranged in a helix and extending outwardly from an exterior surface of the auger shaft; and wherein the auger further comprises one or more grinding plates that extend outwardly from the exterior surface of the auger shaft; wherein each grinding plate has a front surface and an opposed rear surface; and wherein one or more of the grinding plates defines one or more holes therein that extend from the front surface to the rear surface.

2. The cutting assembly as defined in claim 1, further comprising a housing having a peripheral wall; said housing extending rearwardly from the rear cutting head; said housing having a rear end that is adapted to be engaged with the casing; and wherein the peripheral wall bounds and defined a bore that forms part of the air passage.

3. The cutting assembly as defined in claim 2, further comprising an annular collar provided on the housing, wherein the collar has a diameter greater than or substantially equal to the second diameter.

4. The cutting assembly as defined in claim 1, further comprising a housing having a peripheral wall; said housing extending rearwardly from the rear cutting head; said housing having a rear end that is adapted to be engaged with the casing; and wherein the peripheral wall bounds and defined a bore that forms a part of the air passage; and wherein the auger is located within the bore of the housing.

5. The cutting assembly as defined in claim 1, wherein the one or more of the grinding plates that define the one or more holes therein further comprise an inner surface that extends between the front and rear surfaces and defines the one or more holes; and wherein at least a portion of the inner surface includes one or more cutting teeth.

6. The cutting assembly as defined in claim 4, wherein the auger shaft defines a bore and the shaft defines a bore; and the bores of the auger shaft and the shaft are in fluid communication and form part of the air passage.

7. The cutting assembly as defined in claim 1, further comprising a housing that extends rearwardly from the front cutting head, wherein the housing has a peripheral wall that bounds and defines a bore; and the peripheral wall is concentric with the shaft; and a portion of the shaft extends through the bore of the housing; and wherein the shaft defines a bore that is in fluid communication with the bore of the housing; and wherein the bore of the housing and the bore of the shaft form part of the air passage.

8. An apparatus for drilling boreholes comprising:

a cutter assembly;

a swivel; and a casing;

wherein the cutter assembly connectable between the swivel and the casing; said cutter assembly comprising:

a front cutting head of a first diameter;

a rear cutting head of a second diameter, wherein the second diameter is greater than the first diameter; and wherein said rear cutting head is located rearwardly of the front cutting head;

a shaft engaging the front cutting head to the rear cutting head; wherein the front cutting head, the rear cutting head and the shaft are rotatable in unison in a first direction about a longitudinal axis of the shaft;

an air passage defined in the cutting assembly; wherein the air passage is in fluid communication with a bore defined by the swivel and with a bore defined by the casing; wherein the apparatus is adapted to be operatively engaged with a remote air source; and wherein pressurized air flowing from the air source through the bore of the swivel and through the air passage entrains cuttings produced by the front cutting head and the rear cutting head and directs the cuttings towards the bore of the casing;

a housing extending rearwardly from the rear cutting assembly and the housing is operatively engaged with the casing;

an auger located within a bore defined by the housing, said auger being operatively engaged with the swivel; wherein said auger is selectively rotatable in the first direction or in a second direction about the longitudinal axis of the shaft and the rotation of the auger is independent of the rotation of the front cutting head, the rear cutting head and the shaft; and wherein the auger comprises an auger shaft defining a bore therein that comprises a part of the air passage; and a plurality of flights extend outwardly from the auger shaft; and wherein the auger further comprises an insert that is engaged within the bore of the auger shaft and the insert includes an end plate defining a plurality of openings therein; wherein the plurality of openings is arranged in a pattern.

9. The apparatus as defined in claim 8, further comprising an annular collar provided on the housing or the rear cutting head; said collar being of a diameter that is substantially equal to the second diameter.

10. A method of drilling an underground borehole comprising steps of:

rotating and moving forward a cutting assembly and a casing extending rearwardly from the cutting assembly;

cutting a first diameter borehole with a front cutting head of a first diameter that is provided on the cutting assembly;

cutting a second diameter borehole with a rear cutting head of a second diameter that is provided on the cutting assembly; where the second diameter is greater than the first diameter; and wherein the rear cutting head is located rearwardly of the front cutting head on a shaft of the cutting assembly;

moving pressurized air rearwardly through a first air passage formed in the front cutting head and through a second air passage formed in the rear cutting head;

entraining cuttings produced by the front cutting head and the rear cutting head in the moving pressurized air; and directing the pressurized air with entrained cuttings into a bore of the casing extending rearwardly from the cutting assembly;

rotating the front cutting head, the rear cutting head and the shaft in a first direction about a longitudinal axis of the shaft;

selectively rotating an auger provided on the cutting assembly in either of the first direction or in a second direction; and directing the pressurized air with entrained cuttings towards the auger and subsequently into the bore of the casing.

11. The method as defined in claim 10, further comprising:

sealing the second diameter borehole with a collar provided on the cutting assembly.

12. The method as defined in claim 10, further comprising:

rotating the front cutting head, the rear cutting head and the shaft at a first speed; and selectively rotating the auger at the first speed or at a second speed that is greater than the first speed or is less than the first speed.

13. The method as defined in claim 10, further comprising:

contacting the entrained cuttings with teeth provided on grinding plates provided on the auger; and reducing a size of the entrained cuttings with the teeth.

14. The method as defined in claim 10, further comprising:

adjusting back pressure in the first air passage and the second air passage by changing a pattern of holes in an end plate provided on the auger.

15. A cutter assembly for drilling boreholes comprising:

a front cutting head of a first diameter;

a rear cutting head of a second diameter that is greater than the first diameter, a shaft extending between the front cutting head and the rear cutting head;

a housing extending rearwardly from the rear cutting assembly and adapted to be engaged with a casing;

an auger located within a bore defined by the housing;

an air passage defined through the cutting assembly; said air passage being adapted to be placed in fluid communication with a remote air source that causes pressurized air to flow through the air passage and entrains cuttings produced by the front cutting head and the rear cutting head and directs the cuttings through the housing and towards a bore of the casing; and wherein the auger includes an auger shaft defining a auger bore therein that comprises a part of the air passage; and an insert engaged within the bore of the auger shaft, said insert generating back-pressure in the auger bore.

16. The cutter assembly as defined in claim 15, further comprising a pattern of openings defined in the insert, said pattern of openings placing the auger bore in fluid communication with the bore of the housing.

17. The cutter assembly as defined in claim 15, further comprising one or more grinding plates extending outwardly from the auger shaft and into the bore of the housing; wherein each of the one or more grinding plates has a front surface and an opposed rear surface; and wherein each of the one or more of the grinding plates defines one or more holes therein that extend from the front surface to the rear surface.

* * * * *